US006273189B1

(12) United States Patent
Gissler et al.

(10) Patent No.: US 6,273,189 B1
(45) **Date of Patent: *Aug. 14, 2001**

(54) DOWNHOLE TRACTOR

(75) Inventors: Robert W. Gissler; Michael W. Holcombe, both of Spring, TX (US); Daniel Purkis, Aberdeen (GB)

(73) Assignee: Halliburton Energy Services, Inc., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/245,468

(22) Filed: Feb. 5, 1999

(51) Int. Cl.[7] ..... E21B 17/10; B60K 1/00; F16L 1/28

(52) U.S. Cl. ..... 166/241.1; 166/243; 180/65.5; 405/184

(58) Field of Search ..... 166/66.7, 65.1, 166/241.1, 241.3; 405/154, 184, 174; 180/65.5, 65.6

(56) References Cited

U.S. PATENT DOCUMENTS

| | | | | |
|---|---|---|---|---|
| 2,742,259 | | 4/1956 | Boucher | 254/134.5 |
| 2,964,110 | * | 12/1960 | Garwood et al. | 166/241.1 |
| 3,401,988 | * | 9/1968 | Pingree | 166/241.1 |

(List continued on next page.)

FOREIGN PATENT DOCUMENTS

| | | | |
|---|---|---|---|
| 0564500B1 | 10/1993 | (EP) | F03C/1/04 |
| W091/16520 | 10/1991 | (WO) . | |
| WO93/18277 | 9/1993 | (WO) . | |
| WO 95/21987 | 8/1995 | (WO) . | |

OTHER PUBLICATIONS

J. Hallundbaek and H. Gravesen; Long Distance Drilling under Environment Sensitive Areas and Densely Populated Areas Enabled By New Drilling Technology; Thermie Conference: *Natural Gas Policies and Technologies, Part II*; all pages; Oct. 14–16, 1992.

HD Systems, Inc.; *Harmonic Drive Gearing Sales Brochure*; all pages.; 1996.

Knut Ostvang, Terje Skeie and Jorgen Hallunbaek; *World's First Successful Horizontal Wireline Tractor Operations*; all pp.; Feb. 4–6, 1997.

ORAD, Ltd.; *Motorised Utility Logging Equipment Sales Brochure*; all pp.; May 1997.

(List continued on next page.)

*Primary Examiner*—Frank Tsay
(74) *Attorney, Agent, or Firm*—Paul I. Herman; J. Richard Konneker

(57) ABSTRACT

A downhole tractor is provided that includes a housing and a first wheel assembly coupled to the housing that is operable to translate away from the housing in a first direction. The first wheel assembly has a first electric motor, a first wheel, and a first reduction gear assembly coupled between the first electric motor and the first wheel. A second wheel assembly is coupled to the housing and is operable to translate away from the housing in a second direction that is opposite to the first direction. The second wheel assembly has a second electric motor, a second wheel, and a second reduction gear assembly coupled between the second electric motor and the second wheel. A fluid ram is coupled to the first and second wheel assemblies for selectively translating the first and second wheel assemblies toward and away from the housing. A first controller is provided for controlling the flow of current to the first and second electric motors. On-board and surface control systems may be incorporated to permit selective active of the wheels assemblies. In addition, couplings and connectors employing shape-memory materials may be included to secure the tractor to coiled tubing or a wireline.

76 Claims, 18 Drawing Sheets

U.S. PATENT DOCUMENTS

| | | | | |
|---|---|---|---|---|
| 3,405,772 | | 10/1968 | Wisenbaker et al. | 175/77 |
| 3,890,905 | | 6/1975 | Clavin | 104/138 |
| 3,969,950 | * | 7/1976 | Rau et al. | 74/391 |
| 4,085,808 | | 4/1978 | Kling | 175/94 |
| 4,192,380 | | 3/1980 | Smith | 166/250.01 |
| 4,243,099 | | 1/1981 | Rodgers, Jr. | 166/65.1 |
| 4,624,306 | | 11/1986 | Traver et al. | 166/53 |
| 4,811,792 | * | 3/1989 | Lembcke et al. | 166/241.1 X |
| 4,843,896 | * | 7/1989 | Napeloni et al. | 166/241.1 X |
| 4,960,173 | * | 10/1990 | Cognevich et al. | 166/241.1 |
| 5,040,619 | | 8/1991 | Jordan et al. | 175/4.51 |
| 5,209,304 | | 5/1993 | Nice | 166/383 |
| 5,211,510 | | 5/1993 | Kimura et al. | 405/184 |
| 5,236,055 | * | 8/1993 | Legal | 180/65.5 |
| 5,306,101 | | 4/1994 | Rockower et al. | 405/154 |
| 5,375,668 | | 12/1994 | Hallundbaek | 175/53 |
| 5,403,122 | | 4/1995 | Granella | 405/184 |
| 5,439,320 | | 8/1995 | Abrams | 405/154 |
| 5,794,703 | | 8/1998 | Newman et al. | 166/381 |

OTHER PUBLICATIONS

Read Well Services AS; *The READ Translog Tractor System Sales Brochure*; all pages.; date unknown.

Welltec Well Technologies; "*Well Tractor: Revolutionary Intervention Technology for Horizontal and Deviated Wells" Sales Brochure*; all pages.; date unknown.

Read Well Services AS; *READ Well Tractor Sales Brochure*; p. 1; date unknown.

SmartTract, Inc., *SmarTract–WL21/8 Sales Brochure*; p. 1; date unknown.

Advanced Technology, Downhole Tractors Expand Extended Reach Possibilities; dated Aug. 1995.

International Search Report Application No.: PCT/GB400/00319.

* cited by examiner

DOWNHOLE TRACTOR

BACKGROUND OF THE INVENTION

1. Field of the Invention

This invention relates generally to downhole tools, and more particularly to a downhole tractor for propelling working strings and wirelines in a wellbore.

2. Description of the Related Art

Subterranean operations in petroleum wells involve the conveyance of pipe, coiled tubing and wireline supported tools from the surface into well bores and vice versa. In vertical wells, and in those wells having only a few degrees of deviation, the axial thrust necessary to convey pipe or coiled tubing strings, or wireline tools, is supplied by gravity. In these situations, the downward thrust applied to the string is equal to the weight of the drill string, minus any buoyancy force due to fluid downhole. For pipe strings in relatively deep wells, this downward axial thrust can be quite formidable, sometimes exceeding 500 tons. Although the weight of a conventional coiled tubing string will be significantly less than a comparably sized drill pipe string, additional axial downward thrust is routinely applied to coiled tubing strings by a coiled tubing injector positioned at the surface.

The retrieval of pipe and coiled tubing strings, and wireline assemblies in vertical and slightly deviated wells is accomplished by applying upward axial thrust to the pipe string, coiled tubing string or wireline assembly as the case may be. In coiled tubing operations, this is routinely accomplished by reversing the direction of travel of the coiled tubing injector. In pipe strings, the pipe string is pulled from the well bore by platform mounted machinery. In wireline operations, though, the wireline conveyed tool or tool assembly is pulled from the well bore by retrieving the wireline or a cable that often is lowered into the well with the wireline assembly.

The situation is more complex in highly deviated and horizontal wells. In these types of wells, gravity can sometimes be relied upon to convey pipe and coiled tubing strings, and wireline assemblies into deviated sections, depending on factors such as the inclination of the well, the weight of the string and the magnitude of buoyant forces acting on the string. However, in most deviated well situations, the string will drag against the walls of the well bore at some point below the commencement of the deviated portion of the well. At this point, the string will not move downward further without the input of additional downward axial thrust. In pipe strings, additional downward thrust may be applied to the pipe string by means of surface equipment in order to advance the string through the deviated or horizontal section. The compressive load capacity of conventional pipe string is such that fairly significant levels of downward thrust may be applied without inelastically deforming or fracturing any of the pipe sections.

The relatively small outer diameters and wall thicknesses of coiled tubing place severe limits on the amount of surface-supplied downward thrust that can be applied to a coiled tubing string without buckling the tubing. Some surface supplied downward thrust is possible, and is usually imparted to the coiled tubing string via the coiled tubing injector.

As the skilled artisan will appreciate, a wireline itself is of little value in applying downward thrust to a wireline assembly. Other measures must be applied to deploy such downhole assemblies in highly deviated and horizontal wells.

Retrieval of pipe and coiled tubing strings, and wireline assemblies is also more complex in deviated and horizontal wells. During retrieval, the string or wireline assembly may bind against the inner walls of the well bore until the string is completely clear of the deviated section. As a consequence, an upward force exceeding the weight of the string or wireline assembly must commonly be applied during retrieval while the string or wireline assembly is within the deviated section. The capacity of the string or wireline assembly to withstand the overpull necessary to move such assemblies upward through a deviated well section is largely a function of the tensile strength of the string or wireline assembly. Conventional pipe strings can routinely withstand fairly significant tensile loads. Thus, their retrieval is largely a function of the power output of platform mounted retrieval machinery. Coiled tubing strings and wireline assemblies are more problematic in that their capacity to withstand tensile loads can be quite limited, particularly for wireline assemblies. If the tensile limit of a coiled tubing string or wireline assembly is exceeded, a costly fishing operation may be required to clear the wellbore.

Downhole propulsion machines, often referred to as "tractors", have been used for several years to facilitate the conveyance of wireline assemblies, and more recently, coiled tubing strings into a well bore. Most conventional tractors can be loosely grouped into two groups, namely, powered-wheel and crawlers. Most conventional wheeled-powered tractors consist of a tubular housing and two or more powered wheels that project from the housing and are designed to engage the inner walls of the casing, string or open hole, as the case may be, to propel the tractor and any portions of pipe or tubing or wireline tools connected thereto. Designers have developed several different types of wheeled tractor designs, some employing electrically powered wheels and some employing hydraulically powered wheels. In contrast, conventional crawlers typically consist of a housing and a reciprocating crawler mechanism that rhythmically engages and disengages the inner walls of the casing, string or open hole, as the case may be, to propel the tractor and any portions of pipe or tubing or wireline tools connected thereto.

Conventional wheeled tractors present certain shortcomings. One disadvantage common to many conventional designs is the lack of redundancy in power output to the propulsion wheels. In many conventional designs, a single power motor is encased within a tubular housing and coupled to multiple wheels by one or a plurality of mechanical linkages. These linkages typically consist of some form of complex shaft and U-joint arrangement with or without gearing, or a chain drive of some type. The difficulty with such designs is that power failure in the single drive motor results in loss of power to all of the drive wheels. Another disadvantage of such conventional designs is the sheer complexity of the mechanical leakages between the drive wheels and the common power motor. Such linkages routinely incorporate several cooperating sets of gears and shafts and/or chain sprockets that require relatively close tolerances in order to operate smoothly and without failure downhole. Another disadvantage common to some conventional tractor designs is the inability to provide axial movement in both directions. It is often desirable to be able to propel a string or wireline apparatus axially in both directions not only for insertion and retrieval purposes but also for downhole adjustment purposes. For example, logging operations routinely require several adjustments of the position of the logging tool relative to the bore hole prior to data acquisition. Such fine tuning of the position of the logging tool relative to the bore hole can be extremely difficult if the propulsion apparatus is limited to a single direction of travel.

Crawler type propulsion tools have the disadvantages of relatively slow travel speed and sometimes jerky longitudinal movements downhole. The relatively slow travel speeds of crawler type propulsion systems is a natural, though undesirable by-product of the reciprocating type of movement associated with the traction members of such devices. That very reciprocating type of movement also can lead to abrupt and jerky movements of the string downhole. Slow insertion and retrieval often translates into higher operating costs for the operator.

The present invention is directed to overcoming or reducing the effects of the one more of the foregoing disadvantages.

SUMMARY OF THE INVENTION

In accordance with one aspect of the present invention, a downhole tractor is provided that includes a housing and a first wheel assembly coupled to the housing that is operable to translate away from the housing in a first direction. The first wheel assembly has a first electric motor and a first wheel coupled to the first electric motor. A second wheel assembly is coupled to the housing and is operable to translate away from the housing in a second direction that is opposite to the first direction. The second wheel assembly has a second electric motor and a second wheel coupled to the second electric motor. Means are provided for selectively translating the first and second wheel assemblies toward and away from the housing.

In accordance with another aspect of the present invention, a wheel assembly for a downhole tractor is provided that includes an electric motor that has a hub, a stator coupled to the hub, and a rotor coupled to the hub. A wheel is coupled to the rotor and a reduction gear assembly is coupled between the rotor and the wheel.

In accordance with another aspect of the present invention, a downhole tractor is provided that includes a housing and a first wheel assembly coupled to the housing that is operable to translate away from the housing in a first direction. The first wheel assembly has a first electric motor, a first wheel, and a first reduction gear assembly coupled between the first electric motor and the first wheel. A second wheel assembly is coupled to the housing and is operable to translate away from the housing in a second direction that is opposite to the first direction. The second wheel assembly has a second electric motor, a second wheel, and a second reduction gear assembly coupled between the second electric motor and the second wheel. A fluid ram is coupled to the first and second wheel assemblies for selectively translating the first and second wheel assemblies toward and away from the housing. A first controller is provided for controlling the flow of current to the first and second electric motors.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
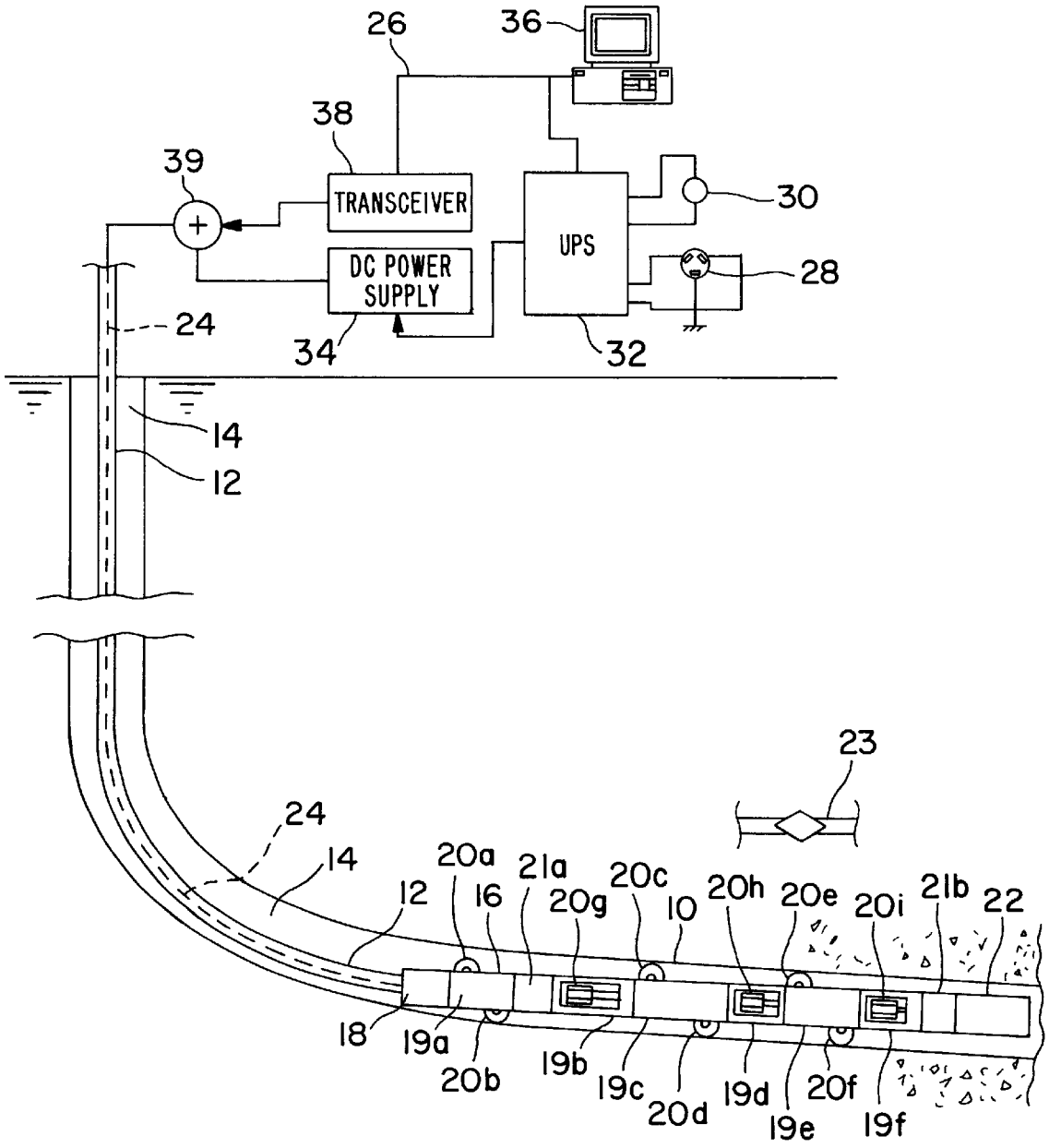
FIG. 1 is a schematic view of an exemplary embodiment of a downhole tractor in accordance with the present invention.

Turning now to the drawings, and in particular to FIG. 1, there is shown an exemplary embodiment of a downhole tractor 10 coupled to a length of coiled tubing 12 and positioned in a deviated wellbore 14. The wellbore 14 may be a cased well, a working string or an open hole, and is of such length that it is shown broken. The downhole tractor 10 includes a tubular housing 16 that is subdivided into various subs. A coupling sub 18 is connected to the tubing 12. A total of six powered wheel modules or subs 19*a*, 19*b*, 19*c*, 19*d*, 19*e* and 19*f* are coupled to the coupling sub 18. Each of the wheel subs 19*a*, 19*b*, 19*c*, 19*d*, 19*e* and 19*f* includes two powered wheel assemblies for propelling the downhole tractor 10. The illustrated embodiment of the downhole tractor 10 includes twelve wheel assemblies. Nine of the wheel assemblies are designated, respectively, 20*a*, 20*b*, 20*c*, 20*d*, 20*e*, 20*f*, 20*g*, 20*h* and 20*i*. Three others are not visible in FIG. 1. Two of the wheel assemblies that are not visible are positioned, respectively, between the wheel assemblies 20*g* and 20*c*, and the wheel assemblies 20*h* and 20*e*. The third is positioned to the right of the wheel assembly 20*i*. Hereinafter, reference to the collective wheel assemblies 20*a*–20*i* should be understood to include the other three wheel assemblies which are not visible, unless stated otherwise.

As described more fully below, the wheel assemblies 20*a*, 20*b*, 20*c*, 20*d*, 20*e*, 20*f*, 20*g*, 20*h* and 20*i* are selectively projectable from the housing 16 so that the downhole tractor 10 can navigate various sizes of wellbores 14. The wheel assemblies 20*a*, 20*b*, 20*c*, 20*d*, 20*e*, and 20*f* translate to and from the housing 16 in the same general plane. The wheel assemblies 20*g*, 20*h*, 20*i*, and three assemblies that are not visible translate relative to the housing 16 in a plane approximately normal to the plane of movement of the wheel assemblies 20*a*, 20*b*, 20*c*, 20*d*, 20*e*, and 20*f*. Electrical and hydraulic power subs 21*a* and 21*b* are provided to deliver electrical and hydraulic power to various portions of the tractor 10. The lower end of the downhole tractor 10 is coupled to another member 22, which may be another downhole tool, such as a shifting tool, a logging tool, a packer, or other type of downhole tool, or another segment of drill pipe or tubing.

If fitted with at least four wheel assemblies, such as the assemblies 20*a*, 20*b*, 20*i*, and the companion assembly to the assembly 20*i* that is not visible, the downhole tractor 10 will be self-centering. However, propulsion may be provided with only two oppositely disposed assemblies, such the assemblies 20*c* and 20*d*. In this case, centering may be ensured by coupling a centering tool 23 to the housing 16.

Electrical power and control signals to and from the downhole tractor 10 are transmitted via a downhole conductor or wireline 24 that is run through the coiled tubing 12 downhole to the downhole tractor 10. The wireline 24 is connected to a surface/control system 26 that includes an AC power supply 28 and a backup battery supply 30 connected to an uninterruptable power supply 32. The output of the uninterruptable power supply 32 is connected to a DC power supply 34 which converts the AC current to DC. A controller 36 is provided to perform a variety of control and data acquisition functions, such as controlling the power supply to the downhole tractor 10, deploying and retracting the wheel assemblies 20*a*–20*i*, and retrieving and displaying data obtained by various sensors in the downhole tractor 10. The controller 36 is connected to the uninterruptable power supply 32 and a transceiver 38. Note that the outputs of both the transceiver 38 and the DC power supply 34 are connected to the wireline 24 via a summing node 39. Accordingly, the transceiver 38 is designed to feed signals from the controller 36 into the wireline 24 and vice versa, that is, receive signals transmitted from the downhole tractor 10. The simultaneous transmission of DC power and electronic control signals between the controller 36 and the downhole tractor 10 is possible through use of an appropriate data/power transmission protocol providing for simultaneous transmission of power and data through a single conductor. An example of a suitable protocol is the segmented network architecture ("SEGNET") supplied by PES, Inc. of The Woodlands, Tex.

Figure 2:
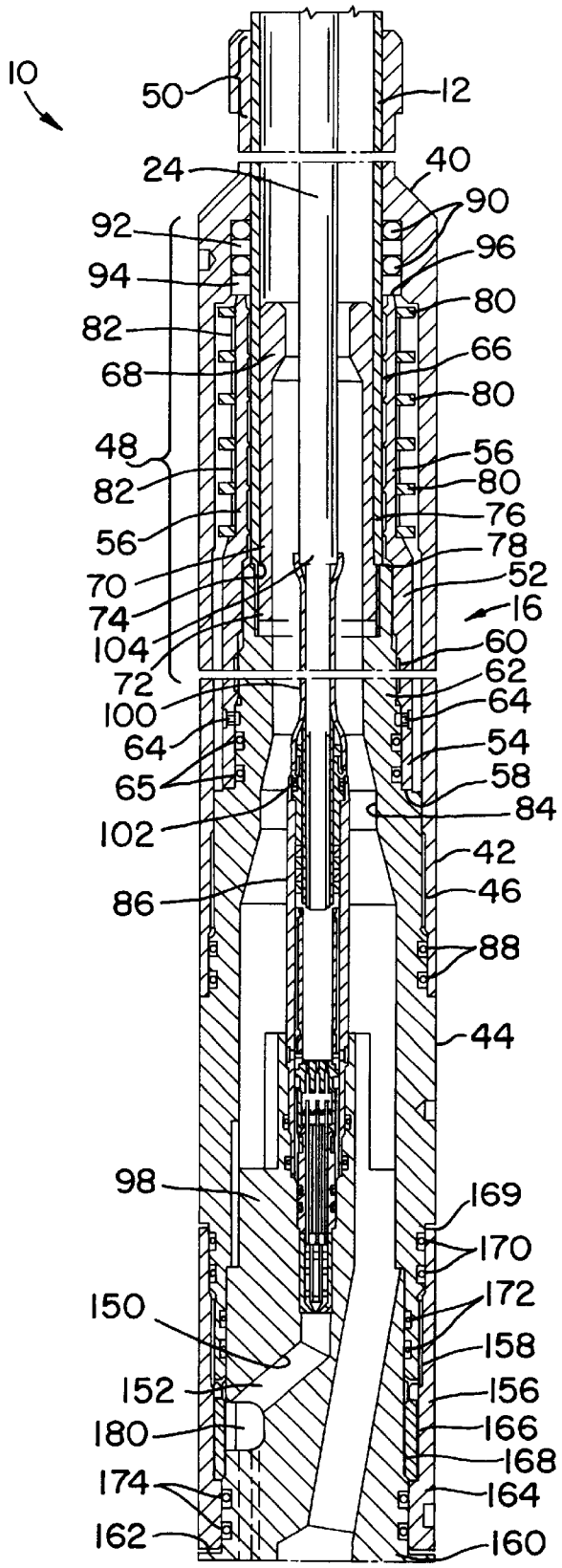
FIG. 2 is a cross-sectional view of the coupling sub of the downhole tractor in accordance with the present invention.
Figure 4:
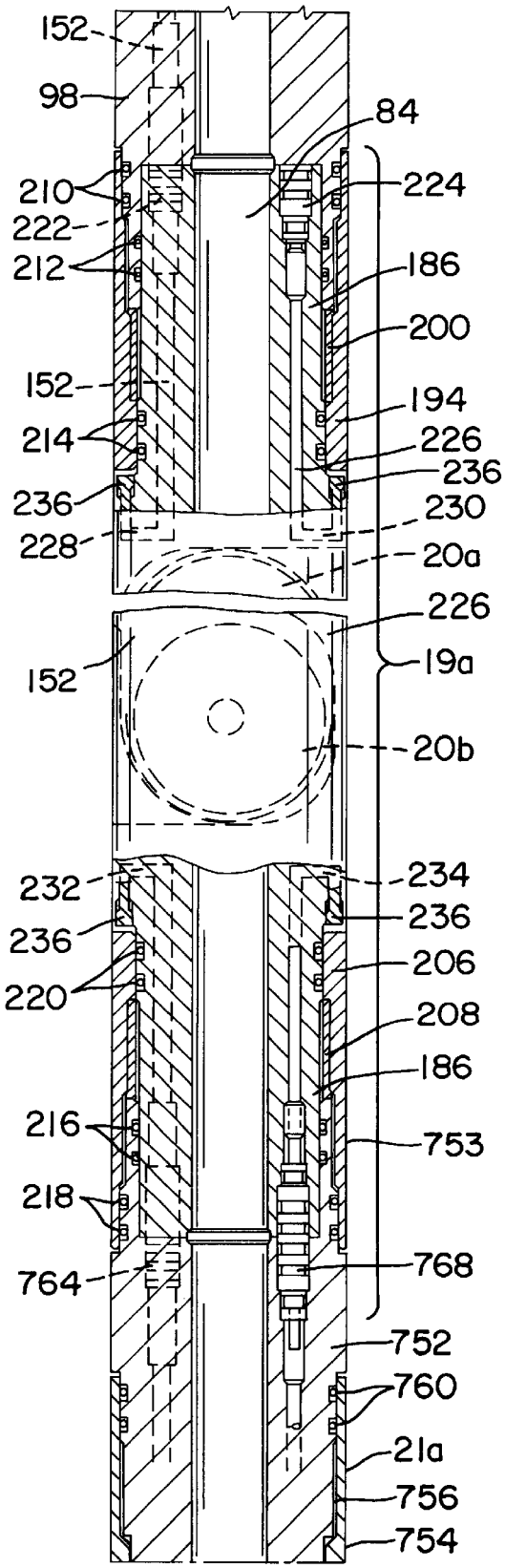
FIG. 4 is a cross-sectional view of one of the wheel modules of the downhole tractor in accordance with the present invention.
Figure 3:
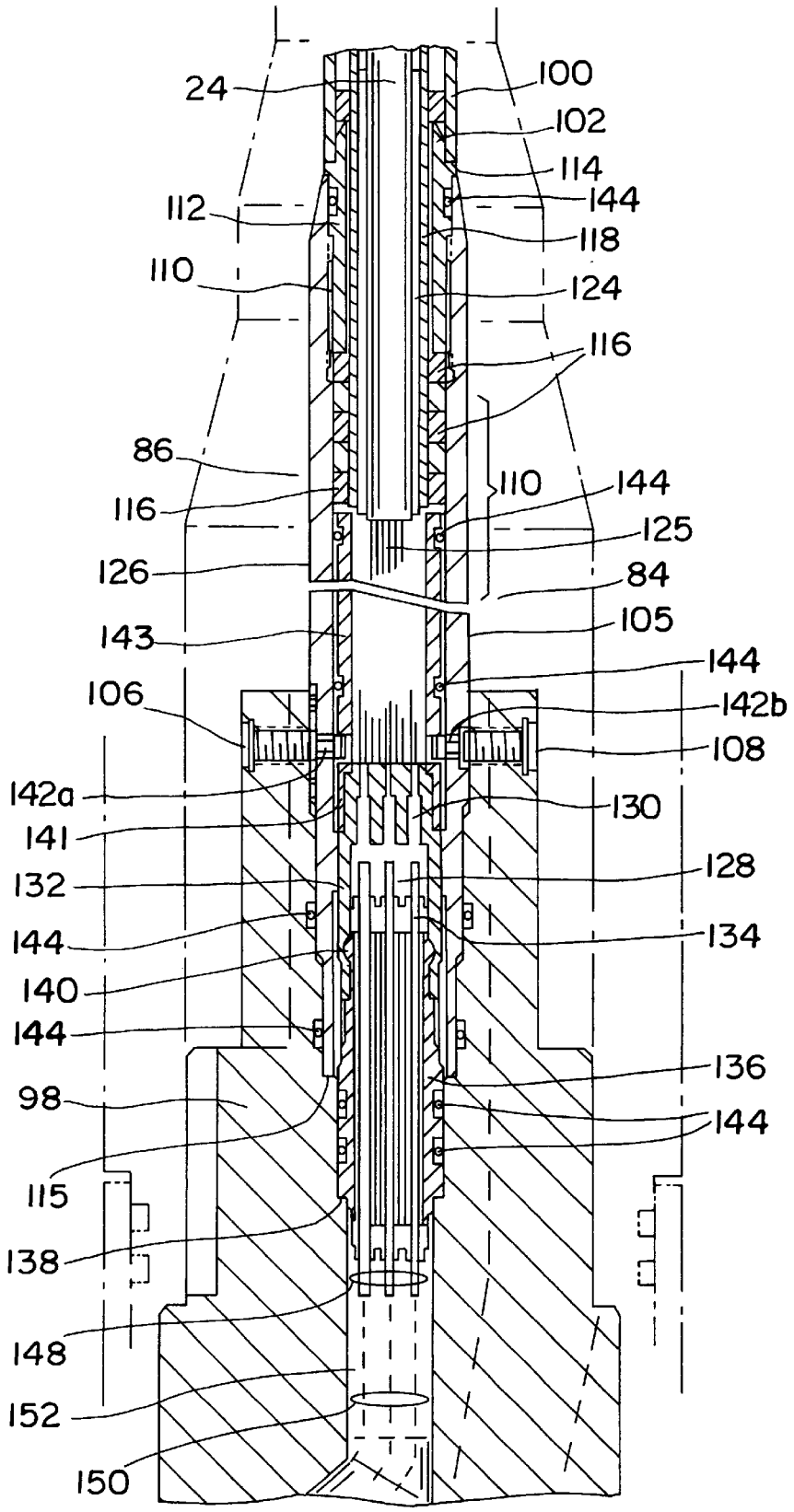
FIG. 3 is a magnified cross-sectional view of a portion of the coupling sub depicted in FIG. 2 in accordance with the present invention.

The detailed structure of the coupling sub 18 and the wheel module 19*a* may be understood by referring now to FIGS. 2, 3 and 4. The sub 18 and wheel module 19*a* are of substantial length necessitating that they be shown in several longitudinally broken sectional views, vis-a-vis FIGS. 2 and 4. This convention for illustrating other lengthy sections of the tractor 10 will be followed herein. The housing 16 of the downhole tractor 10 generally consists of a number of tubular segments joined together, preferably by threaded interconnections. An upper section 40 of the housing 16 has an upper tubular portion 42 threadedly attached to an intermediate tubular section 44 at 46 to provide a housing for a coiled tubing coupling 48 that connects the downhole tractor 10 to the coiled tubing 12. The upper tubular portion 42 includes an internal bore 50 that is dimensioned to receive the end of the coiled tubing 12.

The intermediate section 44 includes a collet 52 that has an annular lower rim 54 and a plurality of longitudinally projecting fingers 56 that project upward from the rim 54 and bear against the exterior of the coiled tubing 12. The rim 54 is seated on an upwardly facing annular shoulder 58 of the intermediate section 44, and is internally threaded at 60 and coupled to the intermediate section 44 at 62. Two or more shear pins 64 beneath the threads 60 prevent the collet 52 from unintentionally loosening. The joint between the rim 54 and the intermediate section 44 is sealed by O-rings 65. The fingers 56 are advantageously composed of a material with sufficient strength and flexure to enable the fingers 56 to be moveable when squeezed against the exterior of the coiled tubing 12, and to withstand the anticipated loads. Exemplary materials include 4140 alloy steel, inconel, and like materials. To enhance the physical engagement between the fingers 56 and the tubing 12, the mating surfaces of the fingers 56 and the tubing 12 may be provided with structures that engage and resist axial movement. For example, some of all of the fingers 56 may be provided with at least one, and advantageously, a plurality of radially inwardly projecting members or teeth 66 that are designed to securely engage the exterior of the coiled tubing 12 when the fingers 56 are brought into tight physical engagement with the coiled tubing 12.

To prevent the fingers 56 from collapsing the tubing 12, a tubular member 68 is positioned between the tubing 12 and the fingers 56. The lower end 70 of the tubular member 68 transitions to an increased diameter portion 72, thereby defining an upwardly facing annular shoulder 74. The outer diameter of the tubular member 68 is dimensioned to be slidably received within the lower end 76 of the coiled tubing 12 so that the end 76 abuts not only the annular shoulder 74, but also an upwardly facing annular surface 78 of the upper end of the intermediate section 44. The tubular member 68 provides a relatively rigid cylindrical member which is designed to prevent the coiled tubing 12 from crimping or otherwise collapsing when the fingers 56 are engaged against the coiled tubing 12.

The collet fingers 56 are brought into secure physical engagement with the exterior of the coiled tubing 12 by one or more longitudinally spaced annular members 80. The annular members 80 are retained in longitudinally spaced-apart relation by a plurality of annular spacers 82. The annular members 80 are advantageously composed of a shape-memory material that deforms in response to a particular stimulus, such as temperature change or exposure to water, for example. A thermally sensitive shape-memory material undergoes dimensional changes when heated above the phase transition temperature for that particular material. When the material has changed dimensions, the deformation is fixed and the shape remains stable.

During fabrication, the annular members 80 are initially fabricated with a permanent shape corresponding to an inner diameter that is smaller than the outer diameter of the collet fingers 56 when the collet fingers 56 are in secure physical engagement with the coiled tubing 12. The fabrication process allows the shape-memory material to be advantageously deformed into a temporary shape with an inner diameter that is greater than the outer diameter of the collet fingers 56 so that the coiled tubing 12 may be readily slipped into position between the tubular member 68 and the fingers 56.

The annular members 80 may then be heated in situ, that is, after they have been installed over the fingers 56 and after the coiled tubing 12 has been inserted in position. The in situ heating may be performed by a resistance heater, a hot air gun, heated blocks, by introducing a hot fluid into the coupling 48 or like methods. Upon heating the annular members 80 above the phase transition temperature, the annular members 80 automatically deform back into their permanent shapes, thereby tightly squeezing the fingers 56 into secure physical engagement with the exterior of the coiled tubing 12. In this way, the coiled tubing 12 is secured to the intermediate section 44 by structural components that, unlike conventional methods such as threaded members and/or axially moving wedges, are not subject to loosening over time as a result of repeated jarring and torsional motions associated with the downhole environment.

The number, size, and spacing, of the annular members 80 is largely a matter of design discretion. Indeed, the plurality of annular members 80 depicted in FIG. 2 may be replaced with a single annular member that shrouds the entirety of, or some lesser portion of the toothed portions of the fingers 56. Exemplary materials for the annular members 80 include a nickel titanium alloy manufactured under the trade names nitinol, tinel, or like materials.

The aforementioned coupling 48 has been described in the context of engagement with coiled tubing. However, the skilled artisan will appreciate that the coupling may be secured to a wide variety of member, such as, for example, a downhole tool, oilfield pipe or like members. Indeed, a well known pin or box connection may be substituted for the coupling 48 in the event a threaded connection is desired.

The section 44 includes a longitudinal bore 84 to permit a working fluid transmitted through the coiled tubing 12 to be passed through the downhole tractor 10 and to permit insertion of the wireline 24 into a connector 86. It is desirable to prevent working fluid pumped through the coiled tubing 12 to escape the housing 16, and similarly desirable to prevent the influx of fluid from the wellbore 14 (See FIG. 1) into the downhole tractor 10. Accordingly, the joint between the intermediate section 44 and the housing upper section 40 is provided with a pair of longitudinally spaced O-rings 88. Similarly, longitudinally spaced O-rings 90 are positioned between the exterior of the coiled tubing 12 and the inner diameter of the section 40. An annular member or spacer 92 is positioned between the O-rings 90, and another annular member 94 is positioned between the lowermost O-ring 90 and abuts the upper ends 96 of the fingers 56.

The wireline connector 86 is connected at its lower end to an intermediate section 98 that is, in turn, coupled to the intermediate section 44. The upper end of the connector 86 is coupled to the wireline 24. A sleeve 100 is provided that is thermally shrunk over the upper end 102 of the connector 86 and the lower end 104 of the outermost insulation jacket of the wireline 24. The sleeve 100 is composed of a material capable of being heat shrunk. The detailed structure of the wireline connector 86 may be understood by referring now also to FIG. 3, which is a highly magnified sectional view of the connector 86. The connector 86 is provided with a tubular housing 105 that is secured to the intermediate section 98 by a pair of opposed shear screws 106 and 108, and optionally, additional such screws. The upper portion of the housing 105 is threadedly coupled at 110 to a tubular section 112 that projects upwardly and has an upwardly facing annular shoulder 114 upon which the sleeve 100 is seated. The lower end of the housing 105 is seated against an upwardly facing annular shoulder 115 of the intermediate section 98. The wireline 24 is secured to the connector 86 by six longitudinally spaced annular members 116 that, like the aforementioned annular members 80 depicted in FIG. 2, are advantageously composed of a heat-sensitive shape-memory material that is deformable in situ from a temporary shape with an inner diameter larger than the outer diameter of the wire rope 118 of the wireline 24 to a permanent shape that has an inner diameter smaller than the outer diameter of the wire rope 118. At least one of the annular members 116 is positioned above the tubular section 112 to shoulder thereon to prevent downward thrust on the wireline 24 from damaging the lower end of the wireline 24. To prevent the annular members 116 from damaging the conductors of the wireline 24, a relatively rigid tubular sleeve 124 is inserted between the wire rope 118 and the inner insulating sleeve 126 of the wireline 24 proximate the annular members 116. The sleeve 124 may be composed of metallic materials, such as carbon or stainless steels or the like. As with the aforementioned coiled tubing coupling 48 shown in FIG. 2, the connector 86 maintains a snug reliable physical engagement with the wireline 24 that is not prone to loosening as a result of downhole forces. In addition, the requirement to separate and bend the individual reinforcing wires of the wireline 24 outward and/or backward to facilitate a conventional wireline coupling mechanism is eliminated. As a result, the potential for fracturing or significantly weakening the reinforcing wires is eliminated.

The lowermost end of the wireline 24 is stripped of the wire rope 118 and the inner insulating sleeve 126 below the annular members 116 to expose the individual conductor wires 122 of the wireline 24. The number of individual conductors 125 of the wireline 24 will depend upon the type of wireline involved. In the illustrated embodiment, the wireline 24 contains seven individual conductors 125.

A pin-socket type connector 128 is positioned inside the housing 110 to connect to the conductors 125. The connector 128 includes a number of terminals 130 coupled to the ends of the individual conductors 125. The terminals 130 may be pin, socket, or another type of connection suitable for mating with the type of connector, e.g., pin or socket. A compliant boot 132 shrouds the terminals 130 and is advantageously composed of a compliant electrically insulating material, such as natural or nitrile rubbers, or like materials. The number of terminals 130 will usually match the number of individual conductors 125 in the wireline 24, but need not depending upon the electrical requirements of the downhole tractor 10. Each terminal 130 is connected to an elongated conductor 134 that spans the length of the connector 128. The conductors 134 are positioned within a tubular section 136 that is shouldered against an upwardly facing annular surface 138 of the intermediate section 98. The boot 132 is slipped over the tubular section 136 and retained thereon by a rim 140 formed on the exterior of the section 136. The upper end of the boot 132 is molded or otherwise secured to a split shell tubular sleeve 141 that is secured to the housing 105 by the set screws 142*a* and 142*b*. A tubular section 143 is seated on the tubular section 141. The tubular section 143 provides additional support for the wireline 24 in the event there is slippage by the annular members 116.

The exterior of the connector 86 is exposed to the working fluid. To prevent working fluid from corrupting the connector 86 and the conductors 125, various O-rings, collectively designated 144, are positioned at various points between the inner and outer surfaces of the housing 105 and the inner surface of the intermediate section 98, and the outer surfaces of the tubular sections 112, 136 and 142. O-rings 146 are provided to hold the split shell section 143 together.

An electrical pathway from the lower end 148 of the connector 86 may be established by separate conductors 150 positioned in one or more conduits 152 in the intermediate section 98. The conduit(s) 152 extends linearly downward for a short distance and then moves obliquely toward the outer diameter of the tractor 10. The conduit(s) 152 extends to the bottom of the tool 10, spanning the various housing sections along the way, and is not always visible in the figures. For simplicity of illustration, a conductor 150 is not always shown in the conduit 152. However, the skilled artisan will appreciate that there will typically be one or more conductors 150 in the conduit(s) 152.

Referring again to FIG. 2, the intermediate section 98 is joined to the intermediate section 44 by an intermediate section 156 that is threadedly attached to the intermediate section 44 at 158. The intermediate section 98 includes a section of expanded diameter 160 that defines an upwardly facing annular shoulder 162 against which the lower end 164 of the intermediate section 156 may abut. An upper annular shoulder 169 of the section 156 is positioned proximate the section 44. The intermediate section 98 is coupled to the intermediate section 156 by a spin collar 166 that engages a set of external threads 168 on the intermediate section 98. The spin collar 166 may be rotated to establish a fixed gap between the opposing annular shoulders 164 and 162. The overall joint between the intermediate section 156, the intermediate section 98, and the intermediate section 44 is sealed against fluid leakage by pairs of longitudinally spaced O-rings 170, 172, and 174. The joint has a self-sealing function. As a result of the differing cross-sectional areas of the annular shoulder 164 and the annular shoulder 169, the differential pressure acting on the intermediate section 156 will tend to urge the intermediate section 156 to remain in physical engagement with the intermediate section 44. Prior to installation of the spin collar 166 and connection between the sections 44, 156, and 98, access to the conductor wires 150 within the conduit 152 may be had through an access port 180.

Referring now to FIGS. 2 and 4, the intermediate section 98 is secured at its lower end to a tubular housing 186 of the wheel module 19*a* by an intermediate tubular section 194 and a spin collar 200. The wheel module 19*a* is, in turn, secured at its lower end to the electrical power section 21*a* by an intermediate tubular section 206 and a spin collar 208. The tubular sections 194 and 206 and the spin collars 200 and 208 are identical in structure and function to the intermediate section 156 and the spin collar 166 described above. In like manner, pairs of O-rings 210, 212, 214, 216, 218 and 220 are provided to aid in sealing the joints. The wheel module 19*a* is of such length that it is shown broken with the wheel assemblies 20*a* and 20*b* shown in phantom. However, the detailed structure and function of the wheel assemblies 20*a* and 20*b* will be detailed in subsequent figures. To enable the set of conductors 150 to be quickly connected and/or disconnected from a complimentary set of conductors (not shown in FIG. 4) in the portion of the conduit 152 in the wheel module 19*a,* a connector 222 like the boot 132, conductor 134 and terminal 128 arrangement shown in FIG. 3 is positioned within the housing 186. Complementary quick disconnect capability for hydraulic fluid supply is provided by a hydraulic coupling 224 positioned in the housing 186. The coupling 224 is in fluid communication with a hydraulic conduit 226. The portion of the conduit 226 above the wheel assemblies 20*a* and 20*b* is not active in the arrangement shown, but may be if hydraulic fluid supply is required above the wheel assembly 20*a*. The detailed structure of the hydraulic coupling will be illustrated in a later figure. Though not visible in FIG. 4, the electric and hydraulic connections between the wheel module 19*a* and the electrical power sub 21 a may include pluralities of the connectors 222 and the couplings 224 circumferentially spaced. The incorporation of multiple connections and couplings may be used at various joints between sections of the tractor 10.

The presence of the wheel assemblies 20*a* and 20*b* requires a reroute of the electrical and hydraulic conduits 152 and 226, and the central bore 84 in the wheel module 19*a*. This is accomplished by moving the conduits 152 and 226 much closer to the outer diameter ("O.D.") of the housing 186 and back via the bends 228, 230, 232 and 234. The portions of the conduits 152 and 226 in the wheel module 19*a* will usually be formed by gun-drilling the ends of the housing 186 below the section 194 and above the section 206, and then cross-drilling to the longitudinally drilled holes. Accordingly, plugs, collectively designated 236, are used to prevent leakage from portions of the longitudinal holes above the bends 228 and 230 and below the bends 232 and 234.

Figure 5:
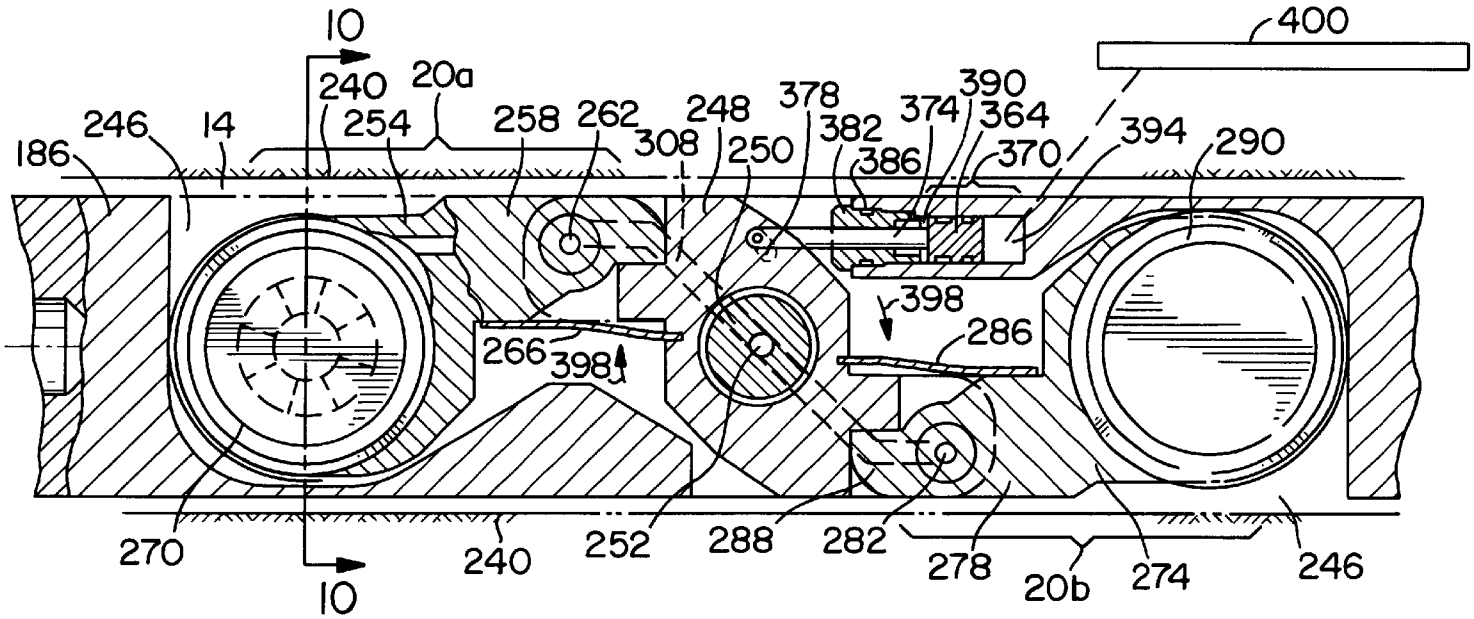
FIG. 5 is a more detailed cross-sectional view of one of the wheel modules in accordance with the present invention.
Figure 6:
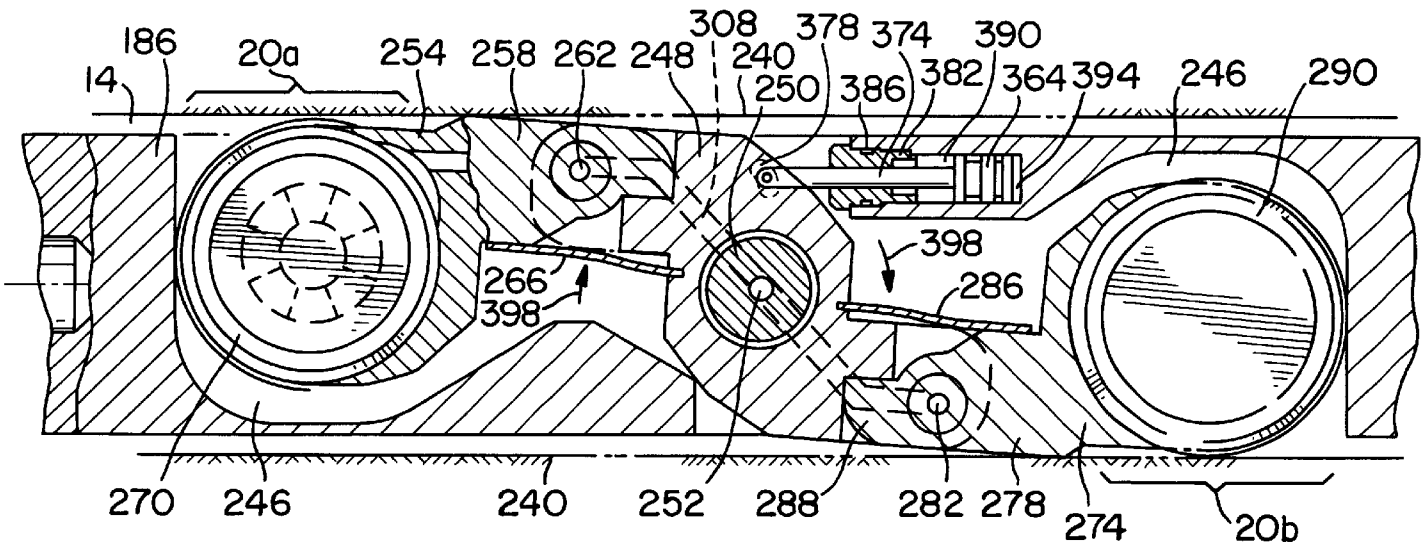
FIG. 6 is a cross-sectional view like FIG. 5 depicting the deployment of the wheel module in accordance with the present invention.
Figure 7:
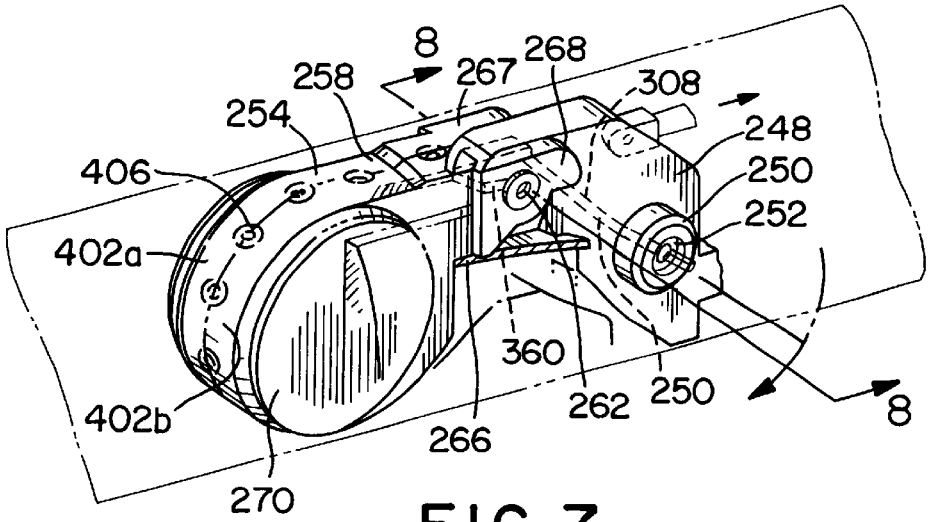
FIG. 7 is a pictorial view of one of the wheel assemblies of the wheel module of FIG. 5 in accordance with the present invention.

The detailed structure and function of the wheel module 19*a* may be understood by referring now to FIGS. 5, 6, 7, 8, 9, 10 and 11. FIGS. 5 and 6 are cross-sectional views like the cross-sectional view shown in FIG. 4, but with the wheel assemblies 20*a* and 20*b* expanded to reveal their structure. The description of the wheel module 19*a* will be illustrative of the other wheel modules 19*b*–19*f* depicted in FIG. 1. The wheel assemblies 20*a* and 20*b* are moveable from the retracted positions shown in FIG. 5 to the deployed positions shown in FIG. 6, and may be selectively deployed to engage the walls 240 of the wellbore 14 to propel the tractor 10. Referring initially to FIG. 5, the wheel assemblies 20*a* and 20*b* are positioned in a slot 246 formed in the housing 186 and are coupled to the housing 186 by a pivot arm 248 that is pivotally coupled to the housing 186 by a pin 250. The pin 250 is provided with a bore 252 through which electrical conductors and hydraulic fluid may be run to provide power and coolant\lubrication to the wheel assemblies 20*a* and 20*b*. Referring now also to FIG. 7, which is a pictorial view of the wheel assembly 20*a* and a portion of the pivot arm 248, the wheel assembly 20*a* includes a hub 254 that is provided with an arm 258 that is pivotally connected to the pivot arm 248 at 262 and is normally biased into the position shown in FIGS. 5 and 7 by a leaf spring 266 that is secured at one end to the pivot arm 248 and is preformed so that its other end bears against the lower surface of the hub arm 258. The hub arm 258 is a forked member having two tines 267 and 268. The wheel assembly 20*a* includes a rotating wheel 270 that is rotatably secured to the hub 254 as described more fully below. The wheel assembly 20*b* includes a similar hub 274 and arm 278 that is pivotally connected to the pivot arm 248 at 282 and is normally biased to the position shown in FIG. 5 by a leaf spring 286 that is coupled to the pivot arm 248 at one end and bears against the upper surface of the hub arm 278 at the other end as shown. The hub arm 278 is also a forked member that includes two tines, only of which is visible and designated 288. The wheel assembly 20*b* includes a wheel 290 that is substantially identical to the wheel 270 of the wheel assembly 20*a*.

Figure 8:
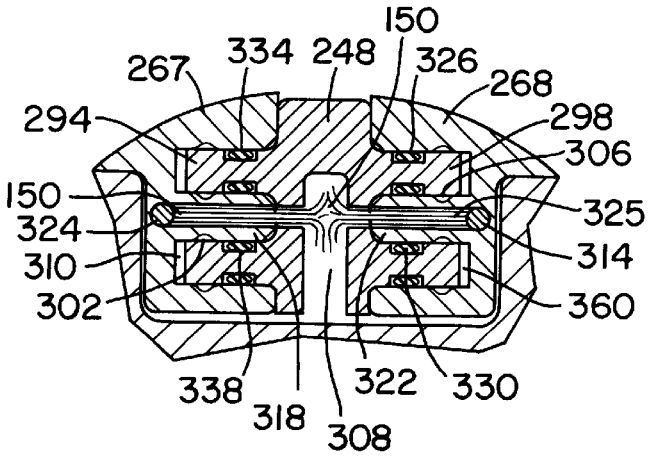
FIG. 8 is a cross-sectional view of FIG. 7 taken at section 8—8 in accordance with the present invention.
Figure 9:
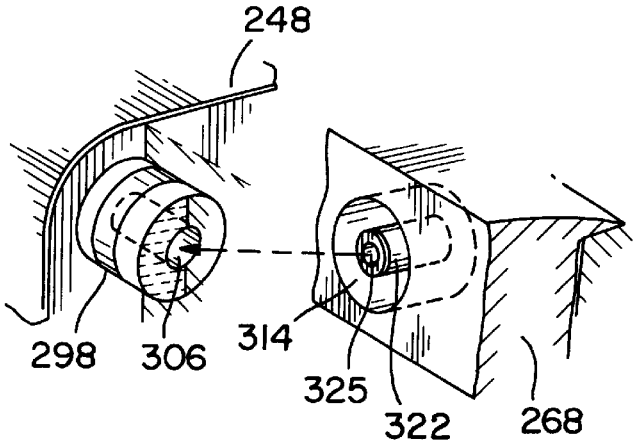
FIG. 9 is an exploded view of a portion of the wheel module depicted in FIG. 7 in accordance with the present invention.

The connection between the hub arms 258 and 278 and the pivot arm 248 is further illustrated in FIGS. 8 and 9. FIG. 8 is a cross-sectional view of FIG. 7 taken at section 8—8, and FIG. 9 is pictorial view of a portion of the tine 268 of the hub arm 258 exploded away from the pivot arm 248. The pivot arm 248 is provided with opposed shafts 294 and 298 in which respective bores 302 and 306 are formed leading to a central slot 308 in the pivot arm 248. The slot 308 is part of a passage that runs down the length of the pivot arm 248 to the bore 252 in the pivot pin 250, and is shown in phantom in FIGS. 5, 6 and 7. The tines 267 and 268 are provided with bores 310 and 314 in which shafts 318 and 322 are formed. The shafts 318 and 322, in turn, have bores 324 and 325. The bores 310 and 314 and the shafts 318 and 322 are dimensioned such that the shafts 294 and 298 are slidably received in the bores 310 and 314 while the shafts 318 and 322 are slidably received in the bores 302 and 306. The pivoting joints between the tines 267 and 268 and the pivot arm 248 are fluid sealed by inner and outer O-rings 326, 330, 334 and 338.

Figure 10:
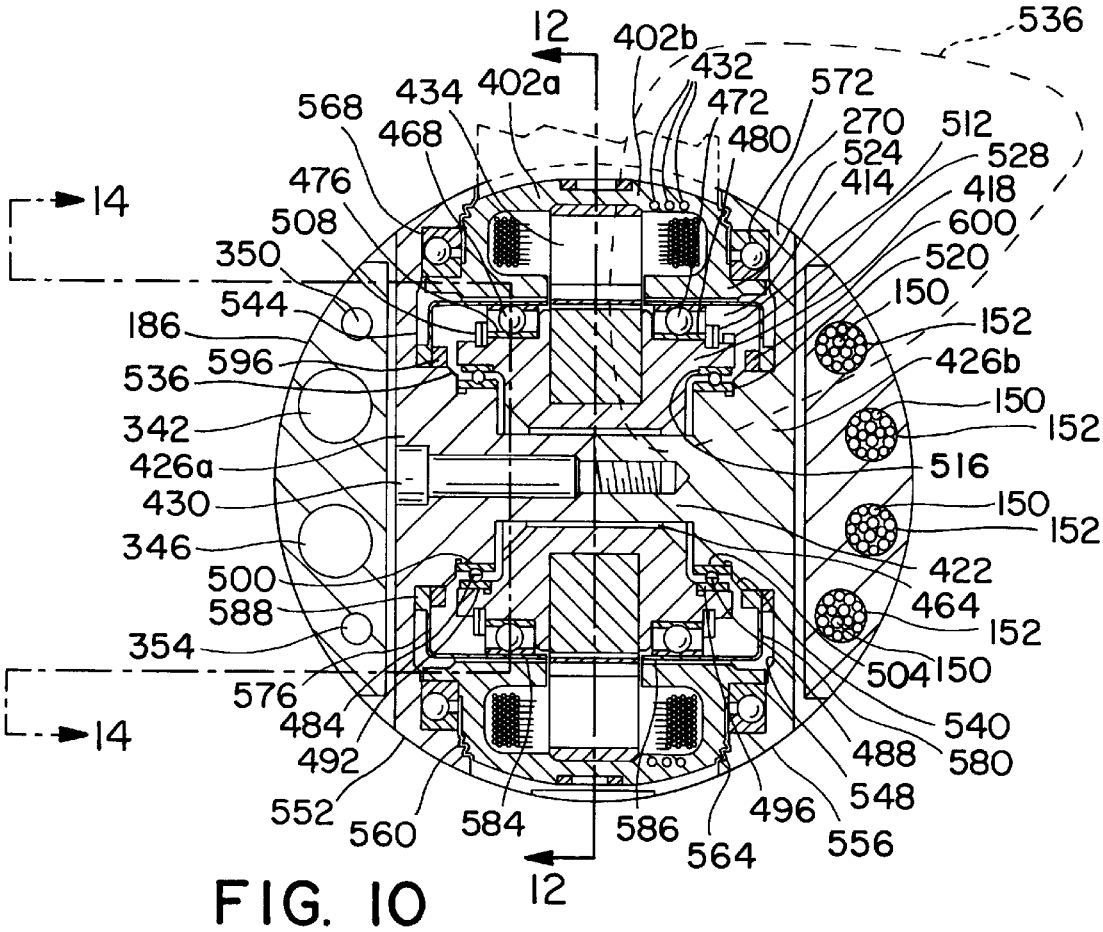
FIG. 10 is a cross-sectional view of FIG. 5 taken at section 10—10 in accordance with the present invention.

The routing of electrical conductors and hydraulic fluid to the wheel assemblies 20*a* and 20*b* may be further understood by referring now to FIGS. 7 and 8, and to FIG. 10, which is a cross-sectional view of FIG. 5 taken at section 10—10. FIG. 10 shows various conduits 342, 346, 350, 354 and 152 in the housing 186. The conduits 342 and 346 are reroutes of the main tool bore 84 shown in FIGS. 2 and 4. The conduits 350 and 354 are reroutes of the hydraulic conduit 226 shown in FIG. 4 and a companion conduit that was not visible in that view. The conduits 152 are similarly rerouted. Conductors 150 and hydraulic fluid may be tapped from any of the conduits 350, 354 and 152 and run into the bore 252 in the pivot pin 250. As shown in FIGS. 7 and 8, conductors 150 and then run from the slot 308 into the bores 324 and 325 of the shafts 318 and 322 and into a conduit 360 drilled into the arms 258 and 278 (though not visible in the arm 278).

Referring again to FIGS. 5 and 6, the wheel assemblies 20*a* and 20*b* are selectively movable out of the slot 246 so that the wheels 270 and 290 may come into contact with the walls 240 of the wellbore 14 to propel the downhole tractor 10. The extension and retraction movement is provided by a fluid ram 364 positioned in a cylinder 370 formed in the housing 186. A connecting rod 374 is coupled to the ram 364 at one end and pin connected at its other end to the pivot arm 248. The pin connection with the pivot arm 248 is provided with a slot 378 so that the pin connection does not bind as the pivot arm 248 rotates. The cylinder 370 is sealed with a cylinder head 382 that is threadedly attached to the cylinder 370 and sealed with an O-ring seal 386. The left and right sides 390 and 394 of the cylinder 370 are in fluid communication with respective hydraulic conduits 350 and 354 (visible in FIG. 10). The conduits 350 and 354 lead to a hydraulic reservoir and pump to be described below. In the illustrated embodiment, the working fluid is hydraulic fluid. The wheel assemblies 20*a* and 20*b* are moved from the retracted position in FIG. 5 to the extended position in FIG. 6 by delivering pressurized fluid to the left side 390 of the cylinder 370. As the ram 364 moves through the cylinder 370, the pivot arm 348 is pivoted in the direction of the arrows 398, causing the wheel assemblies 20*a* and 20*b* to simultaneously pivot in opposite directions away from the housing 186. Depending upon the inner diameter of the well bore 14, one or both of the wheel assemblies 20*a* and 20*b* may come into contact with the inner walls 240 of the wellbore 14. The pivotal connections of the arms 258 and 278 to the pivot arm 248 as well as the leaf springs 266 and 286 enable the wheel assemblies 20*a* and 20*b* to absorb a significant amount of jarring force due to irregularities in the wellbore 14 and other forces that may be imparted to the wheel assemblies 20*a* and 20*b*.

To retract the wheels assemblies 20*a* and 20*b* from the extended position shown in FIG. 6 to the retracted position shown in FIG. 5, pressurized fluid is delivered to the right side 394 of the cylinder 370 and fluid is dumped from the left side 390 of the cylinder 370 to translate the pivot arm 348 in the direction opposite to the arrows 398.

Multiple arrangements of cylinders 370 and rams 364 may be coupled to the pivot arm 248 to enhance the level of available force that may be applied to the pivot arm 248. In another variation, another ram and cylinder arrangement (not shown) like the ram 364 and cylinder 370 may be coupled to the pivot arm 248 proximate the hub arm 278 of the wheel assembly 20*b* so that additional torque may be applied to the pivot arm 248. The hydraulic ram 364-cylinder 270 arrangement may be replaced by an electrical motor 400 coupled to the pivot arm 248. The motor 400, represented schematically by the member 400, may have a rotating shaft connected to the connecting rod 374 via a worm gear, or may be a linear motor with a shaft coupled to the connecting rod 374. Optionally, although not shown in the drawings, the wheel assemblies 20*a* and 20*b* may be decoupled and independently pivotally coupled to the housing 186.

Figure 11:
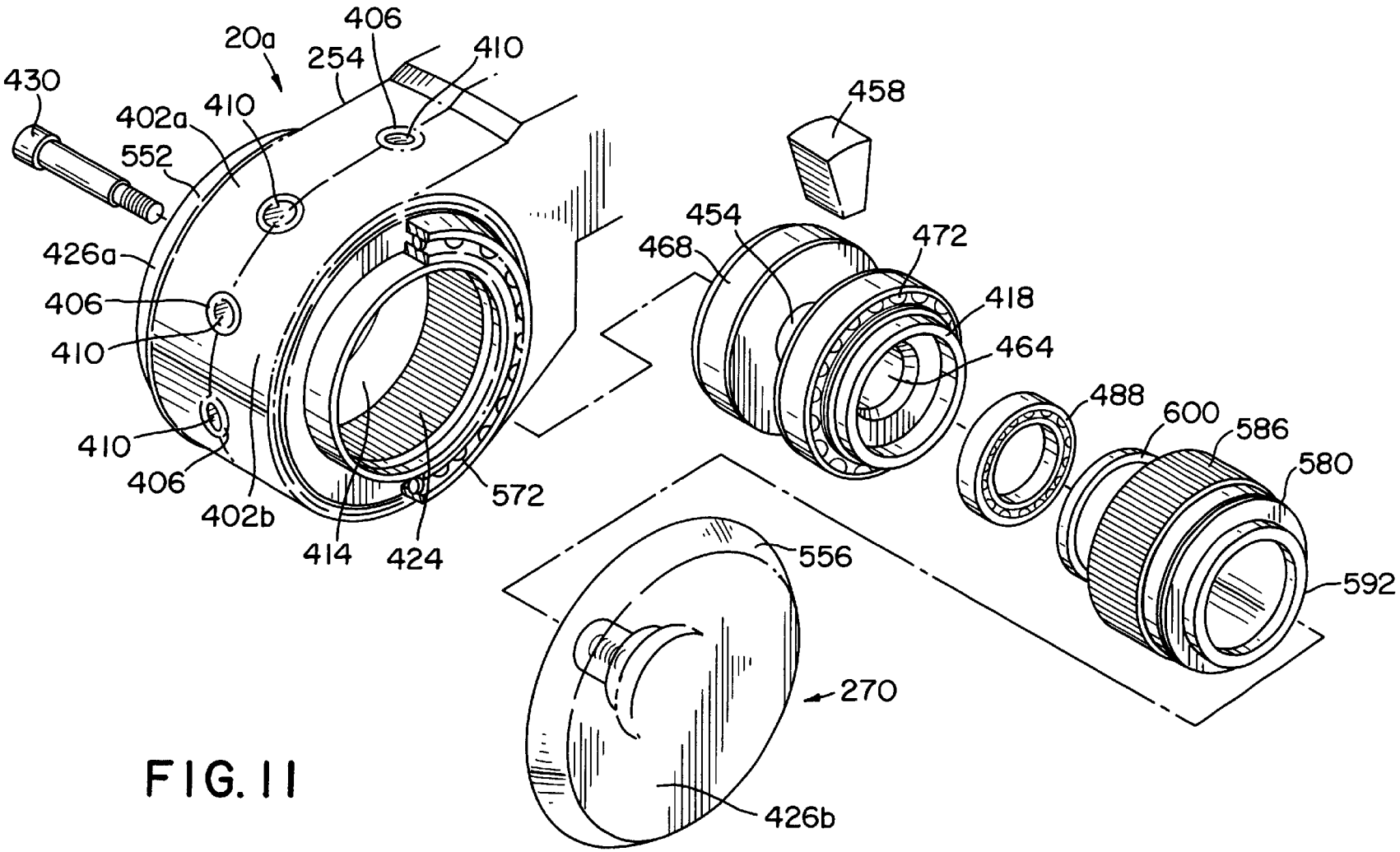
FIG. 11 is an exploded pictorial view of one of the wheel modules depicted in FIG. 5 in accordance with the present invention.

The detailed structure of the wheel assembly 20*a* may be understood by referring now to FIGS. 7, 10, 11, and 12 and initially to FIGS. 7, 10 and 11. FIG. 11 is a partially exploded pictorial view of the wheel assembly 20*a*. The description of the structure and function of the wheel assembly 20*a* will be illustrative of the other wheel assemblies 20*b*–20*i*. The hub 254 consists of mating halves 402*a* and 402*b* joined together by a plurality of shrink rings 406 that are snugly secured around a plurality of buttons 410 machined or otherwise formed into the mating halves 402*a* and 402*b* that come together when the halves 402*a* and 402*b* are joined. The hub 254 has a central bore 414 in which a rotor 418 and a centralized mandrel 422 of the wheel 270 are rotatably mounted. As best seen in FIG. 11, the internal bore 414 of the hub 254 is circular in cross-section and is provided with sets 424 of gear teeth, one each in each half 402*a* and 402*b*. The function of the sets of gear teeth 424 will be described in more detail below. The wheel 270 consists of mating halves 426*a* and 426*b* joined together in the bore 414 by a shoulder bolt 430. Various well know fastening techniques may be used in addition to or in lieu of a bolt connection. The mandrel 422 is defined by the reduced diameter tubular mating portions that are joined together by the shoulder bolt 430. Referring again to FIG. 10, hydraulic fluid and electrical conductors (not visible) are introduced into the hub via openings 432 in the hub 254 which lead to the passage 360 shown in FIG. 7.

Figure 12:
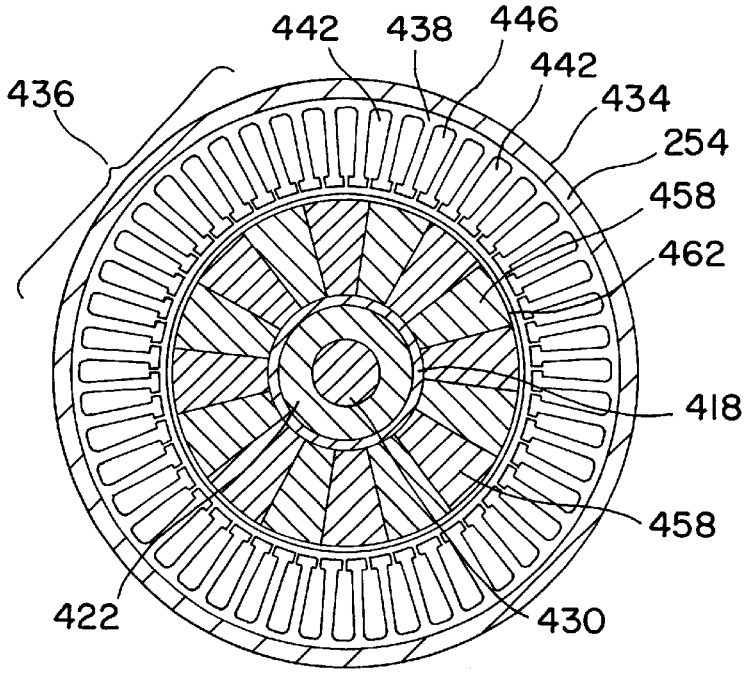
FIG. 12 is a cross-sectional view of FIG. 10 taken at section 12—12 in accordance with the present invention.

Referring now also to FIG. 12, which is a cross-sectional view of FIG. 10 taken at section 12—12, the hub 254 encloses a stator 434, which, together with the rotor 418, makes up the electric motor 436 to drive the wheel 270. Referring now also to FIG. 12, the stator 434 consists of a cylindrical core 438 that includes a plurality of evenly spaced slots 442 punched or otherwise cut out of the internal circumference thereof. A stator winding 446 is dispersed in the slots 442. For simplicity of illustration, only very small portion of the stator winding 446 is depicted in FIG. 12. The number size and spacing of the slots 442 as well as the number of coils and gauge of wire for the stator winding 446 is largely a matter of design discretion.

The detailed structure of the rotor 418 may be understood by referring now to FIGS. 10, 11 and 12. The rotor 418 consists of a cylindrical member that is provided with an external annular slot 454 in which a plurality of permanent magnets 458 are disposed. The magnets 458 are retained in the slot 454 by interference and by a shrink ring 462 that is slipped over the outer diameter of the magnets 458. The rotor 418 includes a central bore 464 through which the mandrel portion 422 of the wheel 270 is rotatably positioned. The rotor 418 is operable to rotate relative to the hub 254 and to the wheel 270. This is accomplished by outer ball bearings 468 and 472 positioned between the outer annular surfaces 476 and 480 of the rotor 418 and the sets of gear teeth 424 on the hub 254. In addition, inner ball bearings 484 and 488 are positioned between the inwardly facing annular surfaces 492 and 496 of the rotor 418 and mating outwardly facing annular surfaces 500 and 504 of the mating halves 426*a* and 426*b* of the wheel 270. The outer ball bearings 468 and 472 are prevented from sliding off of the rotor 418 by pairs of snap rings 508 and 512 that are seated in annular slots formed in the outer diameter of the rotor 418. The inner ball bearings 484 and 488 are prevented from significant axial movement relative to the rotor 418 by oppositely facing annular shoulders 516 and 520 formed in the rotor 418 and the mating halves 426*a* and 426*b* (numbered only for half 426*b*) of the wheel 270. For reasons to be described in detail below, the outer annular surfaces 476 and 480, and the respective inner and outer rings of the outer ball bearings 468 and 472 are provided with an elliptical cross-section.

The combination of the stator 434 and the rotor 418 is intended to function as a three-phase brushless dc motor, although an AC motor may also be used. Power switching between the three phases of the stator 434 is accomplished by solid state switching positioned in another portion of the downhole tractor 10 to be described more fully below. To enable the motor control circuitry to properly control the switching of the power to the various phases of the motor 436, a Hall effect sensor 524 is positioned in or otherwise attached to the hub 254 and is designed to sense the position of one or more permanent magnets 528 coupled to the rotor 418.

Figure 13:
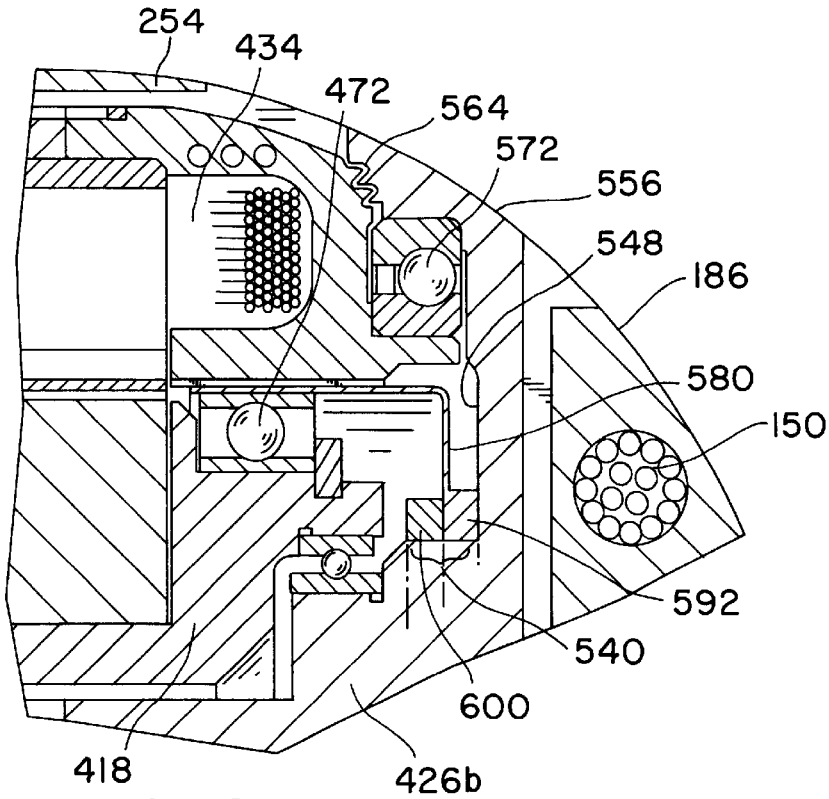
FIG. 13 is a magnification of a portion of the cross-sectional view in FIG. 10 in accordance with the present invention.

The detailed structure of the wheel 270 may be understood by referring now to FIGS. 10, 11 and 13, which is a magnified detailed view of the portion of FIG. 10 generally circumscribed by the dashed oval 532. The mating halves 426*a* and 426*b* of the wheel 270 include inwardly projecting annular rims 536 and 540 that transition to annular flat surfaces 544 and 548. The extreme radii of the mating halves 426*a* and 426*b* are provided with rounded traction surfaces 552 and 556 that are designed to smoothly engage the inner surfaces of the well bore 14. Labyrinth seals 560 and 564 are provided between the mating surfaces of the traction surfaces 552 and 556 and the stationary hub 254. Rotation of the wheel 270 relative to the hub 254 is facilitated by ball bearings 568 and 572 that are positioned in a pocket formed between the traction surfaces 552 and 556 and outwardly facing annular shoulders formed in the hub 254.

The transmission of torque from the rotor 418 to the wheel 270 may be understood by referring now to FIGS. 10, 11 and 13. A reduction gear assembly consisting of reduction gears 576 and 580 is positioned in the bore 414 of the hub 254. The structure of the reduction gears 576 and 580 are substantially identical and may be best seen in FIG. 11, which shows only the reduction gear 580. The reduction gears 580 and 584 are cup-like members that provided at one end with respective sets of external gear teeth 584 and 586 and terminate at the other in annular rims 588 and 592. The external gear teeth 584 and 586 are designed to mesh with the internal gear teeth 424 of the hub 254 as described more fully below. The annular rims 588 and 592 are held snugly against the annular flat surfaces 544 and 548 of the wheel 270 by shrink rings 596 and 600. This interference fit between the annular rims 588 and 592 and the annular flat surfaces 544 and 548 transmits torque from the reduction gears 576 and 580 to the wheel 270. The reduction gears 576 and 580 are advantageously composed of a relatively flexible metallic material that is capable of flexure in response to movement of the elliptical cross-section ball bearings 468 and 472 and the rotor 418. Resistance to fatigue failure and corrosion are desirable properties for the reduction gears 576 and 580. Exemplary materials include, for example, alloy or stainless steel, or the like.

Figure 14:
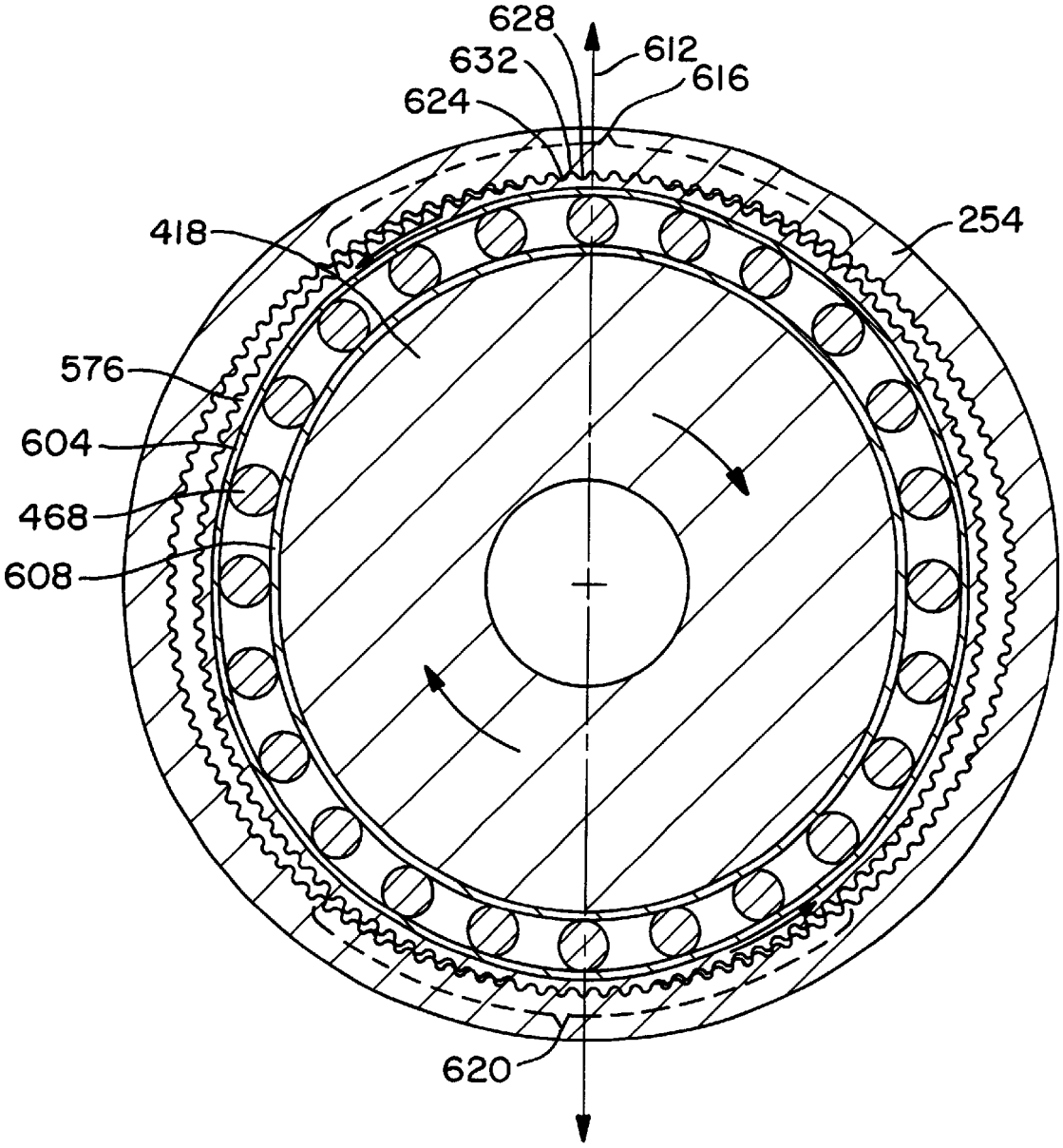
FIG. 14 is a cross-sectional view of FIG. 10 taken at section 14—14 in accordance with the present invention.
Figure 15:
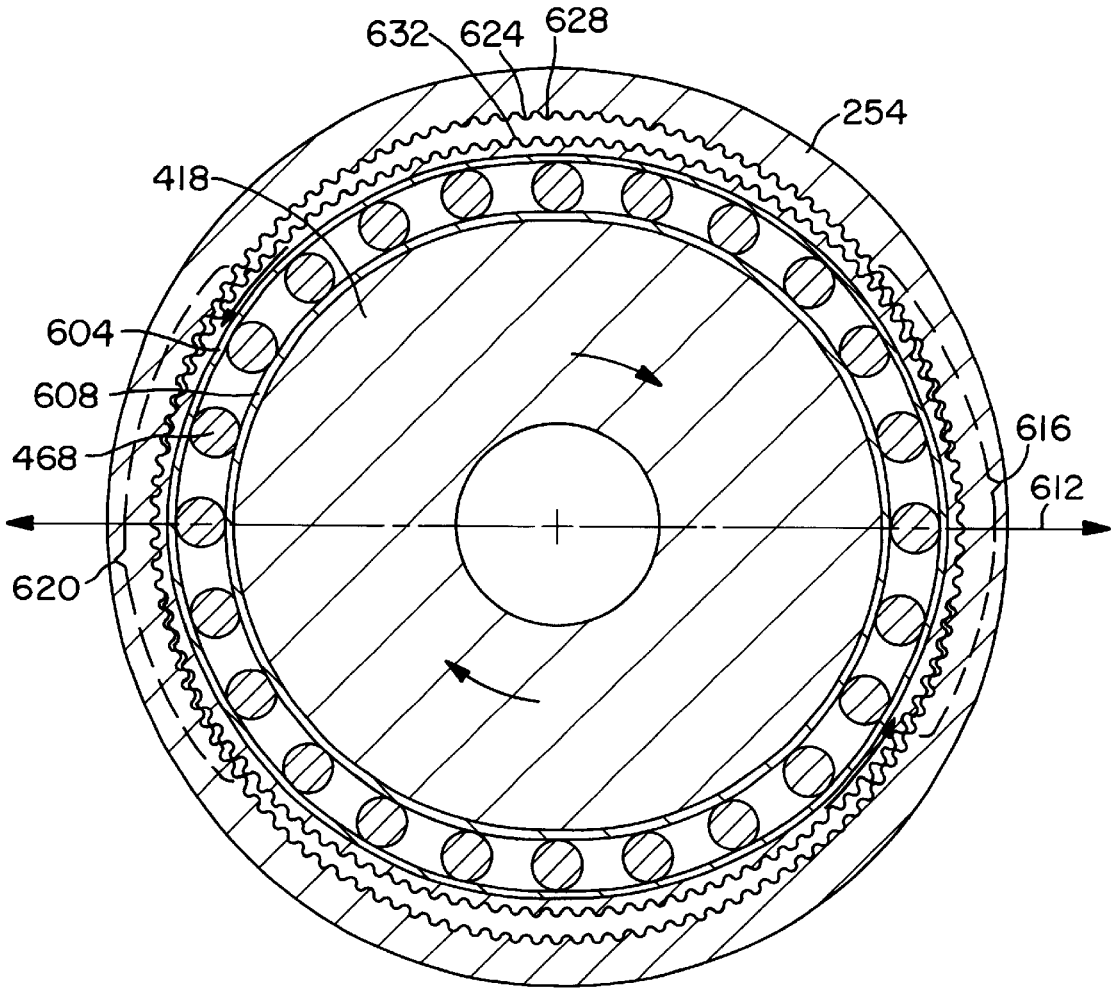
FIG. 15 is a cross-sectional view like FIG. 14 showing the relative rotation of various components of the motor for the wheel assembly in accordance with the present invention.

The detailed movements of the reduction gears 576 and 580 and the rotor 418 relative to the hub 254 may be understood by referring now to FIGS. 10, 14 and 15. FIGS. 14 and 15 are cross-sectional views of FIG. 10 taken at section 14—14 at two different instants during rotor 418 rotation. FIG. 14 depicts the rotor 418 at an initial position relative to the hub 254 and FIG. 15 depicts the rotor 418 after one quarter of a clockwise rotation. As noted above, the rotor 418 and the ball bearing rings (now designated 604 and 608) have an elliptical cross-section. The major elliptical axis for the rotor 418 and the ball bearing rings 604 and 608 is designated 612. As a result of the elliptical cross-sections of the rotor 418 and the ball bearing rings 604 and 608, and the compliant character of the reduction gear 576, the external gear teeth 584 of the reduction gear 576 engage the internal gear teeth 424 of the hub 254 in two opposite zones 616 and 620 across the major elliptical axis 612. As the rotor 418 is rotated from the position shown in FIG. 14, a quarter turn to the position shown in FIG. 15, the zones 616 and 620 of engagement between the external teeth 584 of the reduction gear 576 and the internal teeth 424 of the hub 254 rotate with the major elliptical axis 612. However, the reduction gear 576 itself actually rotates in the direction opposite to the direction of rotation of the rotor 418. The counter-rotational movement may be understood by focusing on two cooperating teeth 624 and 628 on the hub 254 and a cooperating tooth 632 on the reduction gear 576. As shown in FIG. 14, the teeth 624 and 628 and the tooth 632 are engaged with the rotor 418 in the position shown. However, when the rotor 418 is rotated a quarter turn clockwise as shown in FIG. 15, the teeth 624 and 628 on the hub 254 remain in the same position while the tooth 632 on the reduction gear 576 has translated through a small angle in the counterclockwise direction. The amount of counter-directional rotation of the reduction gear 576 in response to a single revolution of the rotor 418 is function of the number and size of the gear teeth 424 on the hub 254 and the teeth 584 of reduction gear 576. In an exemplary embodiment, the hub 254 is provided with N gear teeth 424 and the reduction gear 576 is provided with N−2 gear teeth 584. With this arrangement, the reduction gear 576 will rotate approximately two teeth 548 for every full revolution of the rotor 418. In this way, a speed reduction ratio of approximately 100:1 may be easily obtained for the wheel 270. Other reduction ratios may be obtained by varying the numbers and sizes of the cooperating teeth 424 and 584 and the diameters of the bore 414 and the gear 576.

Figure 16:
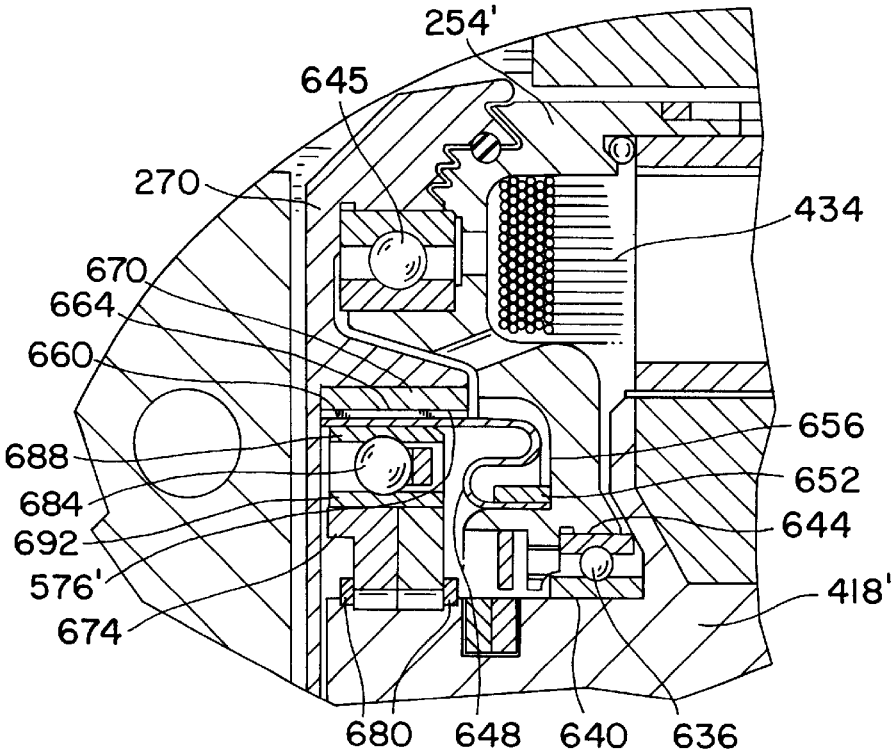
FIG. 16 is a cross-sectional view of a portion of an alternate exemplary embodiment of a wheel assembly in accordance with the present invention.

Several variations of the gearing arrangement between the rotor 418, the reduction gears 576 and 580 and the wheel 270 are possible. For example, in the foregoing illustrated embodiment, the rotor 418 provides the torque input, the hub 254 is fixed and the reduction gears 576 and 580 serve as the output to transmit torque to the wheel 270. That combination results in rotation of the reduction gears 576 and 580 and the wheel 270 in a direction opposite to the direction of rotation of the rotor 418. However, in an alternate exemplary embodiment, the rotor 418 may serve as the input with the equivalent of the aforementioned internal gear teeth 424 on the hub 254 replaced by a set of internal gear teeth coupled to the wheel that rotate in the same direction as the input. This alternative embodiment may be understood by referring now to FIG. 16, which is a sectional view of a portion of the alternate exemplary embodiment and is similar in scope, but opposite in orientation to the view depicted in FIG. 13. In this illustrative embodiment, the hub, now designated 254', is again stationary and houses the stator 434. Relative rotational movement between the rotor, now designated 418' and the hub 254' is provided by a ball bearing 636 positioned between an annular shoulder 640 of the rotor 418' and an annular shoulder 644 formed in the hub 254'. A bearing 645 provides rolling movement of the wheel 270 relative to the hub 254'. The reduction gear, now designated 576', is flip-flopped from the orientation depicted in FIG. 10, and is provided with an S-like set of folds 648 at one end that terminate in an annular rim 652 that bears against an outwardly facing flat annular surface 656 of the hub 254'. The S-like folds 648 provide enhanced capability for flexure of the reduction gear 576' under load, and shorten the length of the gear 576', thereby saving space. The external gear teeth 660 of the reduction gear engage a cooperating set of internal gear teeth 664 fashioned in an annular member 670 that has a generally circular cross-section and provides the same general functionality as the internal gear teeth 424 formed in the bore 414 of the hub 254 in the foregoing illustrated embodiment. The rotor 418' is provided with an annular member 674 that is secured thereto by a pair of snap rings 682. A ball bearing 684 is snugly positioned between the exterior surface of the annular member 674 and the interior of the reduction gear 576' proximate the gear teeth 660 thereof. Both the annular members 674 and 678 and the ball bearing rings 688 and 692 are provided with an elliptical cross-section of the type depicted in the foregoing illustrated embodiment. When the rotor 418' is rotated, the teeth 660 of the reduction gear 576' are brought into engagement at zones across the major elliptical axis of the annular members 674 and 678 and the ball bearing rings 688 and 692 in a manor like that described above in conjunction with FIGS. 14 and 15. However, since the reduction gear 576' is fixed, the rotor 418' and the wheel 270 rotate in the same directions.

Figure 17:
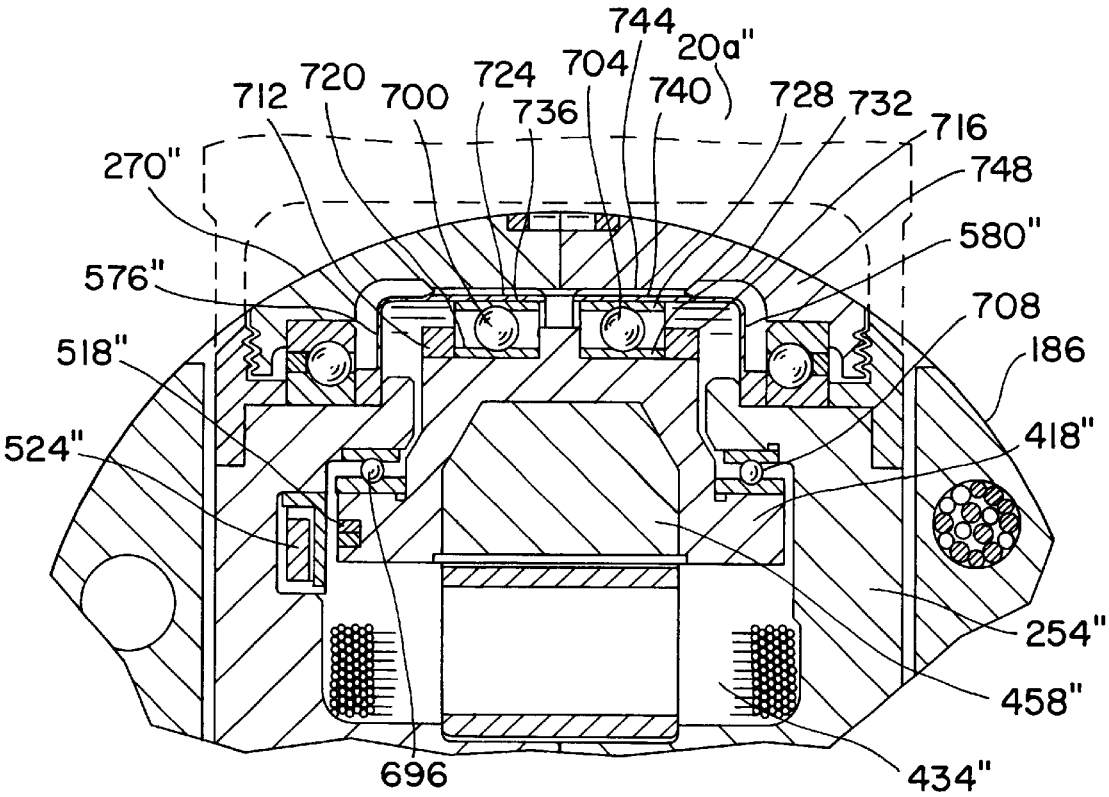
FIG. 17 is a cross-sectional view of a portion of another alternate exemplary embodiment of a wheel assembly in accordance with the present invention.

In the foregoing illustrated embodiment, the rotor 418 is positioned inside the hub 254 with the stator 434 positioned in the hub 254 but external to the rotor 418. However, the arrangement may be flip-flopped. FIG. 17 illustrates a sectional view of the upper portion of an alternate embodiment incorporating this flip-flopped arrangement. FIG. 17 is a sectional view of similar perspective as FIG. 10, although only the upper portion of the wheel assembly, now designated 20*a*" is illustrated. In this embodiment, the stator, now designated 434", is again positioned in the hub, now designated 254". However, the rotor, now designated 418", is rotatably positioned around the stator 434" and rotatably supported by inner and outer ball bearings 696, 700, 704 and 708. The rotor 418" is again supplied with a plurality of permanent magnets, now designated 458". The outer ball bearings 700 and 704 are retained in position by a pair of shrink rings 712 and 716. The rotor 418" and the respective rings 720, 724, 728 and 732 of the outer bearings 700 and 704 are again provided with an elliptical cross-section of the type described above to enable external gear teeth 736 and 740 of the reduction gears, now designated 576" and 580" to engage a set of internal gear teeth formed in the traction surface 748 of the wheel, now designated 270" as described above in conjunction with FIG. 16. As with the embodiment illustrated in FIG. 16, the rotor 418" provides input torque and the wheel 270" receives the output torque while the reduction gears 576" and 580" remain stationary. The rotor 418' and the wheel 270" rotate in the same direction. The position and speed of the rotor 418" may again be determined by a Hall effect sensor, now designated 524" and a corresponding set of permanent magnets 528" mounted on the rotor 418".

Figure 18:
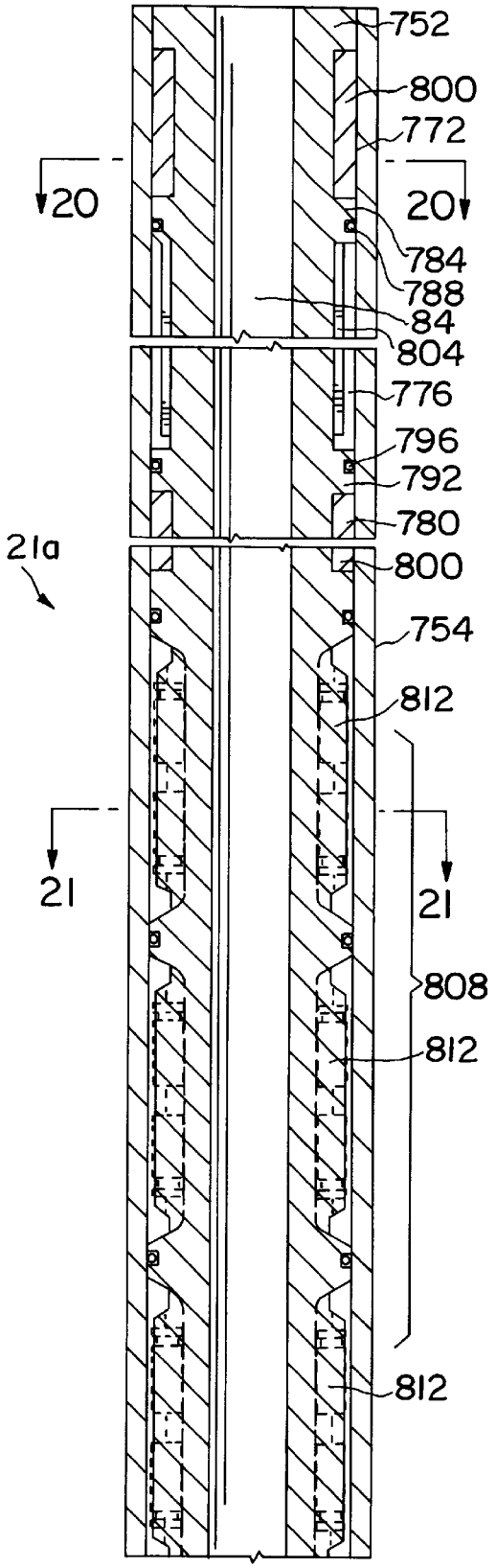
FIGS. 18 and 19 are cross-sectional views of the electrical power sub depicted in FIG. 1 in accordance with the present invention.

The structure of the electrical power sub 21*a* may be understood by referring now to FIGS. 4, 18, 19, 20, 21 and 22. As shown in FIGS. 4 and 18, the electrical power sub 21*a* has a tubular housing 752 that is threadedly engaged to the wheel module 19*a* at the threaded connection 753 with the tubular section 206. The housing 752 has a tubular jacket 754 that extends longitudinally and is threadedly secured to the housing 752 at 756. The joint at 756 is sealed with pairs of O-rings 760. Electrical and hydraulic connections between the wheel assembly 19*a* and the electrical power sub 21*a* are provided by one or more electrical connectors 764 and hydraulic couplings 768, which may be substantially identical to the connector 222 and hydraulic coupling 224 shown in FIG. 4.

Figure 20:
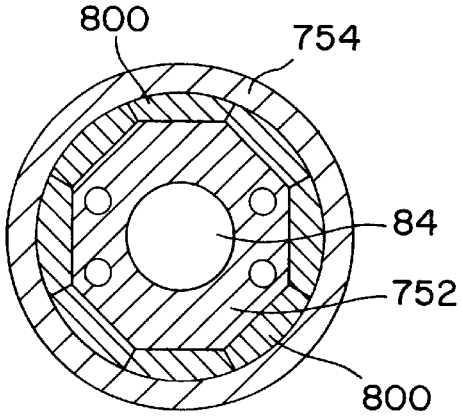
FIG. 20 is a cross-sectional view of FIG. 18 taken at section 20—20 in accordance with the present invention.

The structure of the electrical power sub 21*a* may be understood by referring now to FIGS. 18, 19, 20, 21 and 22, and initially to FIG. 18. The housing 752 includes several longitudinally spaced-apart reduced diameter sections 772, 776, and 780 separated by sets of annular flanges 784, 788 and 792, each having a shock absorbing elastomeric ring 796. As best seen in FIG. 20, which is a cross-sectional view of FIG. 18 taken at section 20—20, the reduced diameter sections 772 and 780 are provided with generally polygonal cross-sections to provide a series of elongated spaces in which magnets 800 for casing collar location may be positioned. A casing collar locator coil assembly 804 is positioned around the section 776 and inductively coupled to the magnets 800.

Primary electrical power is supplied to the downhole tractor 10 via the wireline conductor 24 shown in FIG. 2.

Figure 21:
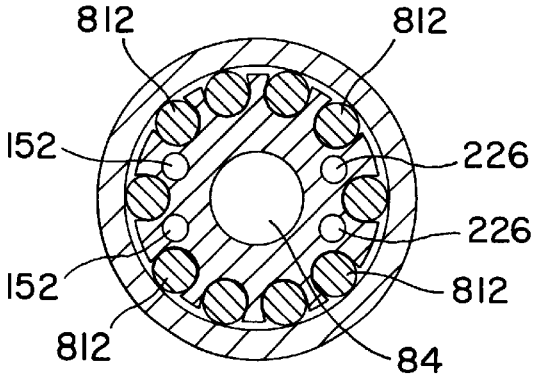
FIG. 21 is a cross-sectional view of FIG. 18 taken at section 21—21 in accordance with the present invention.

This includes the electrical power necessary to power the wheel modules 19*a*–19*f* and operate the instrumentation of the tractor 10. It is desirable to incorporate an onboard power supply to ensure that power is consistently supplied to the control circuitry for the wheel assemblies 20*a*–20*i* even under rapidly changing current flow conditions. In this regard, a power supply 808 in the form of a plurality of peripherally spaced capacitors 812 is positioned inside the housing 752. As better seen in FIG. 21, which is a cross-sectional view of FIG. 18 taken at section 21—21, the capacitors 812 are connected to a conductor in one of the conduits 152 via a connection that is not visible in FIGS. 18 or 21. In addition to capacitors, thermal batteries may be used. FIG. 21 also illustrates how several hydraulic conduits 226 run throughout the tractor 10 to supply fluid to the wheel modules 19*a*–19*f* shown in FIG. 1.

Figure 19:
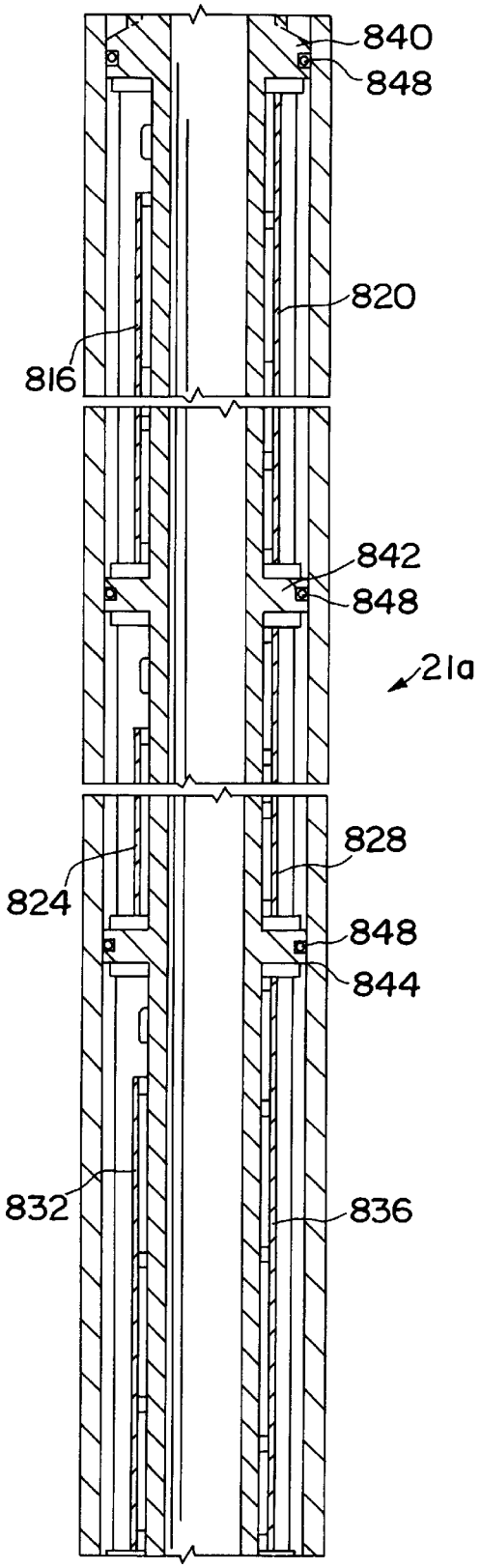

Referring now to FIG. 19, the electrical power sub 21*a* includes printed circuit boards 816, 820, 824, 828, 832 and 836 positioned in various annular spaces between the housing 752 and the housing jacket 754. The spaces are separated by flanges 840, 842 and 844 which are provided with compliant shock absorbing rings 848. The boards 816, 820, 824, 828, 832 and 836 may be fabricated from polycarbonate plastic, polyimide, ceramic materials, or other suitable types of substrate/circuit board materials. The components and interconnections of the boards 816, 820, 824, 828, 832 and 836 will be described in more detail below.

Figure 22:
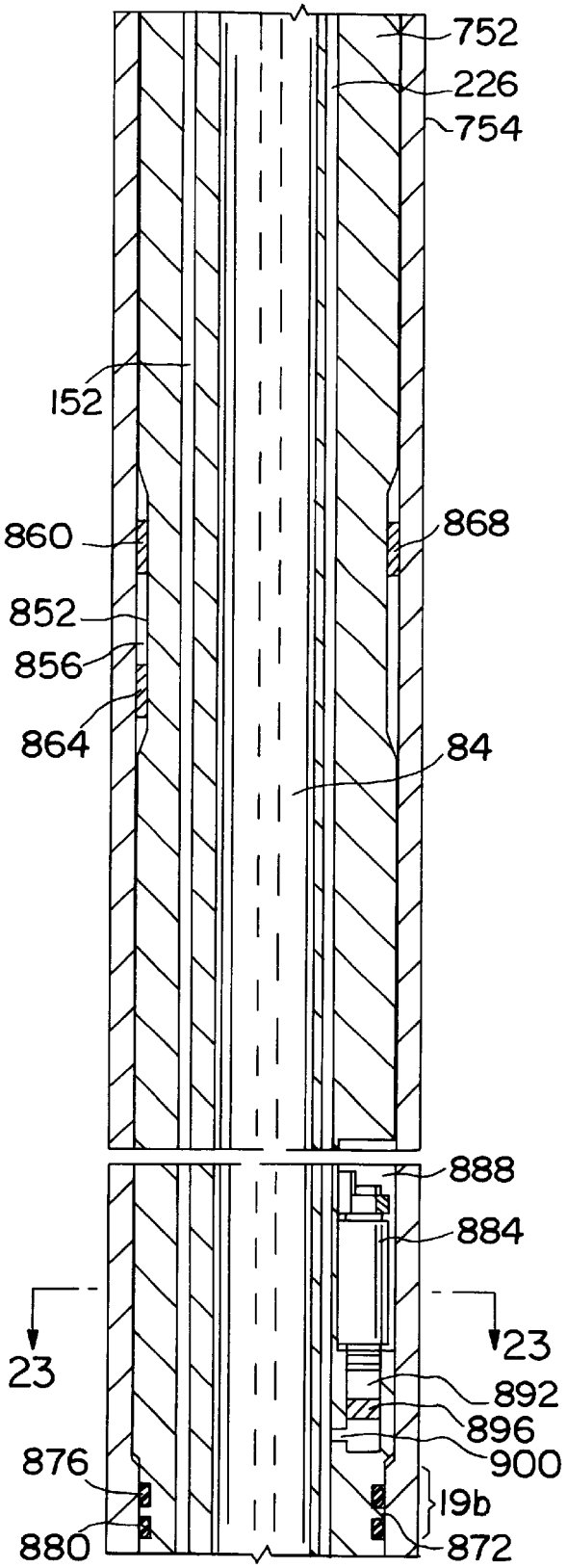
FIG. 22 is a cross-sectional view of the lower end of the electrical power sub depicted in FIGS. 18 and 19 in accordance with the present invention.

As shown in FIG. 22, the housing 752 is provided with a reduced diameter portion 852 that provides an annular chamber 856 between the exterior of the intermediate section housing 752 and the interior of the jacket 754. The annular chamber 856 provides room to accommodate one or more strain gauges 860, 864, and 868 for measuring tensile, compressive, torsional, and bending strains on the tractor 10. The electrical outputs of the strain gauges 860, 864, and 868 are connected to one of the boards 816, 820, 824, 828, 832 or 836. The gauges 860, 864, and 868 are mounted on the reduced diameter portion 852 and are not physically connected to the interior surface of the intermediate section jacket 754. Furthermore, the gauges 860, 864, and 868 are additionally isolated from strains subjected to the intermediate section jacket 754 that might otherwise contaminate the readings of the gauges 860, 864, and 868. This is accomplished by physically connecting the intermediate section housing 752 to the housing 186 of the wheel module 19*a* only at one end, namely at the threaded connection 753 shown in FIG. 4. At the lower terminus of the housing 752 shown in FIG. 22, the housing 752 is not threadedly engaged with the wheel module 19*b*. Rather, a sliding joint at 872 is established and sealed against fluid intrusion by a pair of O-ring seals 876 and 880. Accordingly, axial and torsional loads are transmitted directly through the housing 752 and loads applied to the jacket 754 by wellbore pressure or other causes are not transmitted directly to the strain gauges 860, 864, and 868. The working fluid pressure does act on the inner diameter of the housing 752. It is therefore necessary to monitor the pressure in the bore 84 so that the pressure effects may be electronically subtracted out of the strain gauge signals.

It is desirable to be able to sense the temperature and pressure of the hydraulic fluid in the conduit 226. These parameters provide verification of the condition of the hydraulic fluid, as well warning of an impending overload. Accordingly, a temperature/pressure sensor 884 is positioned in a chamber 888 defined by the housing 752 and the jacket 754. One end of the temperature/pressure sensor 884 includes electrical outputs that are routed to one of the boards 816, 820, 824, 828, 832 or 836 shown in FIG. 19. The other end of the sensor 884 is coupled to a substantially sealed chamber 892. A compensating piston 896 is disposed in the chamber 892. The chamber 892 is in fluid communication with the conduit 226 via the port 900. The chamber 892 and the piston 896 are configured so that the pressure on either side of the piston 896 is essentially equal. Thus, the pressure of the fluid in the conduit 226 will be readily sensed by the sensor 884. Several such sensors 884 may be positioned in the tractor 10 to sense the conditions in the various conduits 226.

Figure 23:
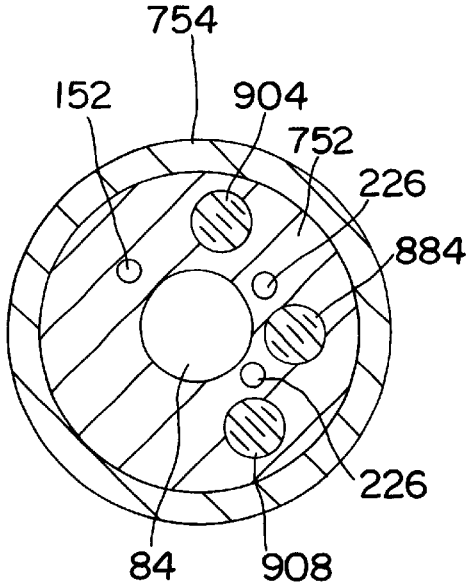
FIG. 23 is a cross-sectional view of FIG. 22 taken at section 23—23 in accordance with the present invention.

The piston 896 serves primarily as a structure to prevent the influx of debris from the chamber 892 which might otherwise contaminate and damage the sensor 884. It is anticipated that heat from the fluid in the conduit 226 will transfer to the fluid in the chamber 892 and thus to the temperature/pressure sensor 884. There will be some time lag between a change in pressure and temperature in the fluid in the conduit 226 and the sensing of those changes by the sensor 884. This time lag is due primarily to frictional forces resisting movement of the piston and to the time lag associated with the transfer of heat from the fluid in the conduit 226 to the fluid in the chamber 892. The types of sensors employed to sense temperature and pressure are largely a matter of design discretion. In an exemplary embodiment, the temperature/pressure sensor 884 incorporates a thermocouple-like element, such as an RTD, and a strain gauge transducer for sensing temperature and pressure. Referring now also to FIG. 23, which is a sectional view of FIG. 22 taken at section 23—23, additional temperature/pressure sensors 904 and 908 may be positioned in the housing 752 to sense the temperature and pressure of the working fluid in the bore 84 and the fluid in the wellbore 14 (See FIG. 1). The sensors 904 and 908 may be substantially identical to the sensor 884.

Figure 24:
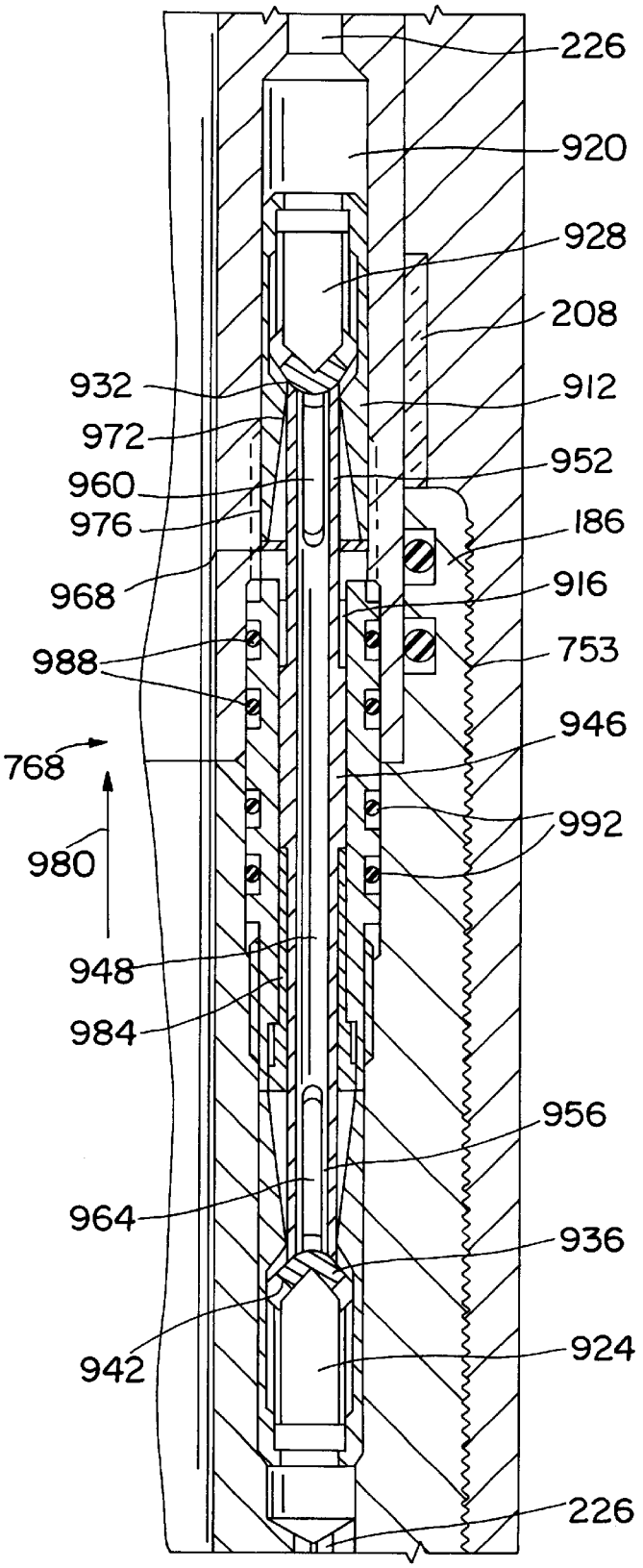
FIG. 24 is a magnified cross-sectional view of a hydraulic coupling depicted in FIG. 4 in accordance with the present invention.

The detailed structure of the various hydraulic couplings to connect the hydraulic conduits of adjoining sections of the tractor 10 may be understood by referring now to FIG. 24, which is a detailed cross-sectional view of the hydraulic coupling 768 shown in FIG. 4. The coupling 768 includes a tubular housing 912 that has a first longitudinal bore 916 extending therethrough and is dimensioned at its upper end and lower end to thread into place over respective check valves 920 and 924 positioned in the conduit 226. The first check valve 920 includes a longitudinally movable poppet 928 that is spring biased against an upwardly facing chamfered surface 932. In like fashion, the check valve 924 includes a poppet 936 that is spring biased toward a chamfered surface 942. The coupling 768 includes a mandrel 946 that is slidably positioned in the bore 916. The mandrel 946 includes a longitudinal bore 948 extending from a first tip 952 to a second tip 956 to convey fluid from the first check valve 920 to the second check valve 924. The first tip 952 includes one or more openings 960 and the tip 956 includes a corresponding opening or openings 964 to permit fluid to enter and exit the bore 948. The first tip 952 includes an outwardly projecting annular member 968 that is longitudinally spaced from the end 972 of the tip 952 so that when the annular member 968 shoulders against the body 976 of the check valve 920, as shown in FIG. 24, the portion of the mandrel 946 distal to the annular member 968 projects into the valve body 976 and unseats the poppet 928 as shown. The mandrel 946 is upwardly biased in the direction indicated by the arrow 980 by a biasing member 984 positioned inside the housing 912 to bias the mandrel 946 toward the check valve 920. The biasing member 984 may be a coiled spring or other type of spring. First and second sets 988 and 992 of O-ring seals are provided between the exterior of the housing 912 and the mating interior surface of the housing 186 and the mating interior surface of the housing 752 to prevent hydraulic fluid from bypassing the bore 948 in the mandrel 946, and to prevent contamination of hydraulic fluid by working fluid.

In operation, the hydraulic coupling 768 is inserted into one or the other of the intermediate sections to be connected, i.e., the housing 186 or the housing 752, and the sections 186 and 752 are brought together at the threaded connection 753. For the purpose of this illustration, it is assumed that the hydraulic coupling 768 is first inserted into the intermediate housing 752 above the check valve 924. When the coupling 768 is secured above the check valve 924, the tip 956 of the mandrel 946 projects into the check valve 924 but does not open the poppet 936. Next, the intermediate section housing 186 is slipped over the coupling 768 and the threaded connection at 753 is tightened to bring the sections 186 and 752 together.

As the sections 186 and 752 are brought together, the annular member 968 shoulders against the valve body 976, the poppet 928 is unseated, opening the check valve 920, and the mandrel 946 is moved longitudinally downward as a result of the engagement between the annular member 968 and the valve body 976. The biasing member 984 maintains the tip 952 in contact with the poppet 928 to maintain the poppet 928 in an open position while the mandrel 946 is moved downward. At the same time, the tip 956 is engaging and unseating the poppet 936 in the check valve 924. When the threaded connection at 753 is fully tightened, the poppets 928 and 936 are held in open positions respectively by the tips 952 and 956 and retained in open positions by the dimensional difference between the mandrel length and the joint makeup distance between the poppets 928 and 936. The spring 984 ensures that the mandrel 946 moves and closes a given poppet when the joint at 753 is broken.

The hydraulic coupling 768 provides the advantageous capability of providing a structure for quickly connecting two ends of a hydraulic conduit, namely the conduit 226, and for maintaining the up and downstream check valves 924 in an open position during normal operations. The ability to maintain an open pathway for hydraulic fluid flow is desirable so that sudden closure of one or the other of the valves 920 or 924 as a result of an unanticipated pressure surge in the chamber 226 or shock loading is avoided. In this way, a potentially damaging water hammer situation is prevented which might otherwise damage various seals or other components in the tool.

Figure 25:
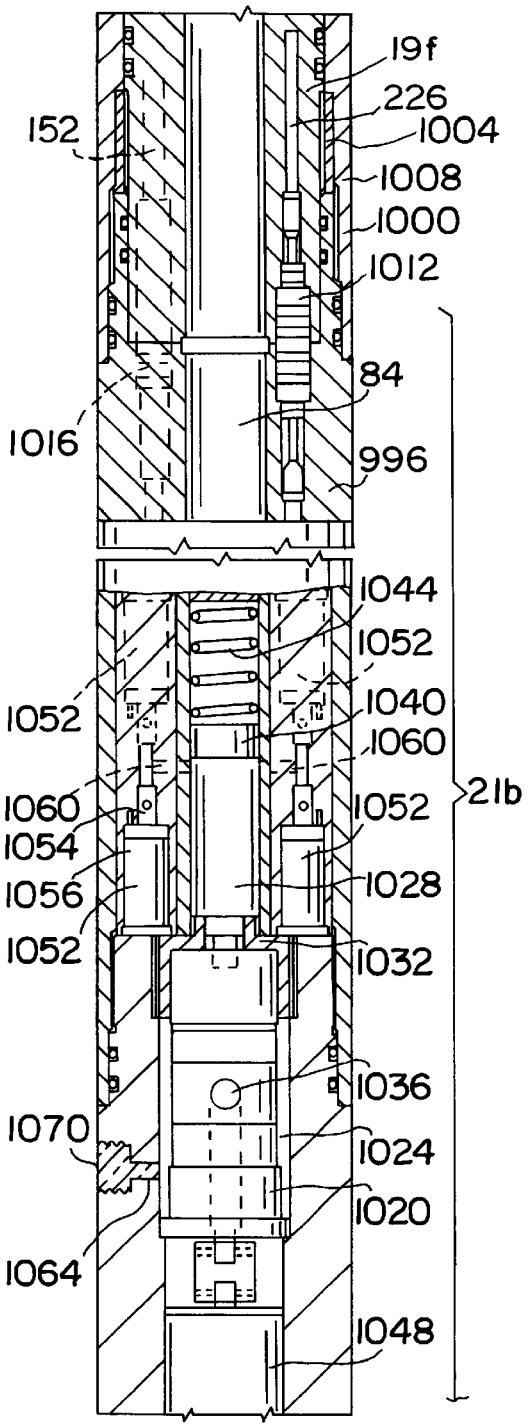
FIGS. 25 and 26 are cross-sectional views of the hydraulic power sub depicted in FIG. 1 in accordance with the present invention.
Figure 26:
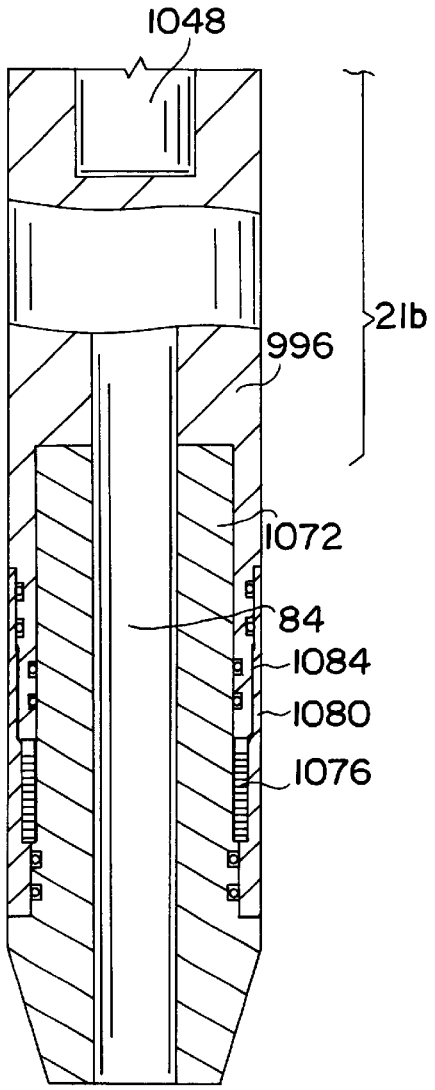

The detailed structure of the hydraulic power sub 21*b* may be understood by referring now to FIGS. 25 and 26. The hydraulic power sub 21*b* includes a tubular housing 996 that is threadedly connected to the lower end of the wheel module 19*f* at the threaded connection 1000. The lower end of the wheel module 19*f* includes a spin collar 1004 and tubular section 1008 of the type described above and designated 194 and 200 in FIG. 4. Quick disconnect of electrical power and hydraulic fluid between the wheel module 19*f* and the hydraulic power sub 21*b* is provided by one or more hydraulic couplings 1012 and electrical connectors 1016 which may be identical to the connectors and couplings 764 and 768 shown in FIG. 4. Pressurized hydraulic fluid is supplied to the conduit 226 and any other similar conduits that are positioned in the tractor 10, but not necessarily visible in FIG. 25, by a hydraulic pump 1020 that is positioned within a substantially sealed chamber 1024 in the housing 996. The hydraulic pump 1020 is in fluid communication with a hydraulic reservoir 1028 that is separated longitudinally from the pump 1020 by a bulkhead 1032. The chamber 1024 will normally have a charge of hydraulic fluid present that feeds into an inlet 1036 of the pump 1020. The reservoir 1028 is pressure compensated by a piston 1040 and a spring 1044 positioned in the reservoir 1028. The backside or spring side of the chamber 1028 is tied to wellbore pressure by a passage that is not visible. The reservoir 1028 is pressure compensated to maintain the pressure therein above a preselected level so that in the event of a fluid seal failure at a particular location in the tractor, fluid will leak out of the tractor 10 instead of material from the ambient leaking into the tractor 10. This is desirable to avoid contamination of the internal workings of the tractor 10. The lower end of the hydraulic pump 1020 is coupled to an electric motor 1048.

To regulate the flow of hydraulic fluid from the reservoir 1028, the hydraulic power sub 21*b* is provided with a plurality of solenoid actuated valves, collectively designated 1052. Each of the solenoid actuated valves 1052 is consists of a solenoid 1054 coupled to a check valve 1056. Each of the valves 1052 is in fluid communication with the reservoir 1028 by means of cross passages 1060. The number of solenoid actuated valves 1052 appropriate for the downhole tractor 10 will depend upon the number of wheel assemblies incorporated into the tractor 10, and on the number of wheel assemblies to be deployed simultaneously. For example, in the illustrated embodiment incorporating twelve wheel assemblies 20*a*–20*i*, two solenoid actuated valves 1052 will be required for each wheel assembly, one to control the deployment and one to control the retraction of the given wheel assembly. Accordingly, the hydraulic power sub 21*b* may contain eight additional solenoid actuated valves of the type shown and designated 1052 but which are not visible in FIG. 25. An initial charge of hydraulic fluid may be delivered to the chamber 1024 via a fill port 1064 that is sealed with a plug 1068.

The lower end of the housing 996 is attached to a pin type connector 1072 which includes a threaded pin type connection for connection to a mating box connector not shown. The connector 1072 includes an upwardly disposed reduced diameter portion that defines an upwardly facing annular shoulder 1074 that abuts the lower end of the intermediate section housing 996. The connection between the lower end of the housing 996 and the pin connector 1072 may be by a spin collar 1076 and exterior tubular section 1080 and a threaded connection at 1084 of the type previously described and shown in the various figures. Other than standard pin/box connections may be used to link the tractor 10 to another tool or member. Referring back to FIG. 25, the flow of working fluid through the main bore 84 is rerouted around the hydraulic pump 1020 and motor 1048 in a manner such as that shown in FIG. 10 in conjunction with the wheel assembly 20*a*. Below the pump motor 1048, the working fluid again is routed back to the main bore 84.

Figure 27B:
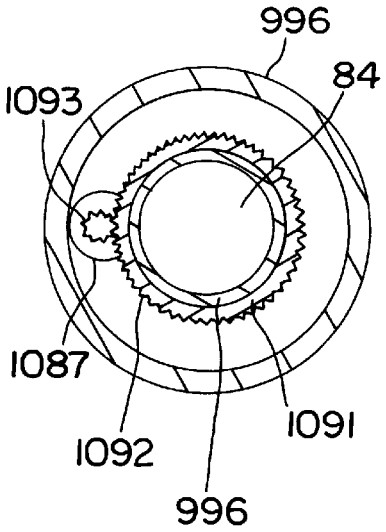
FIG. 27B is a cross-sectional view of FIG. 27A taken at section 27B—27B in accordance with the present invention.
Figure 27A:
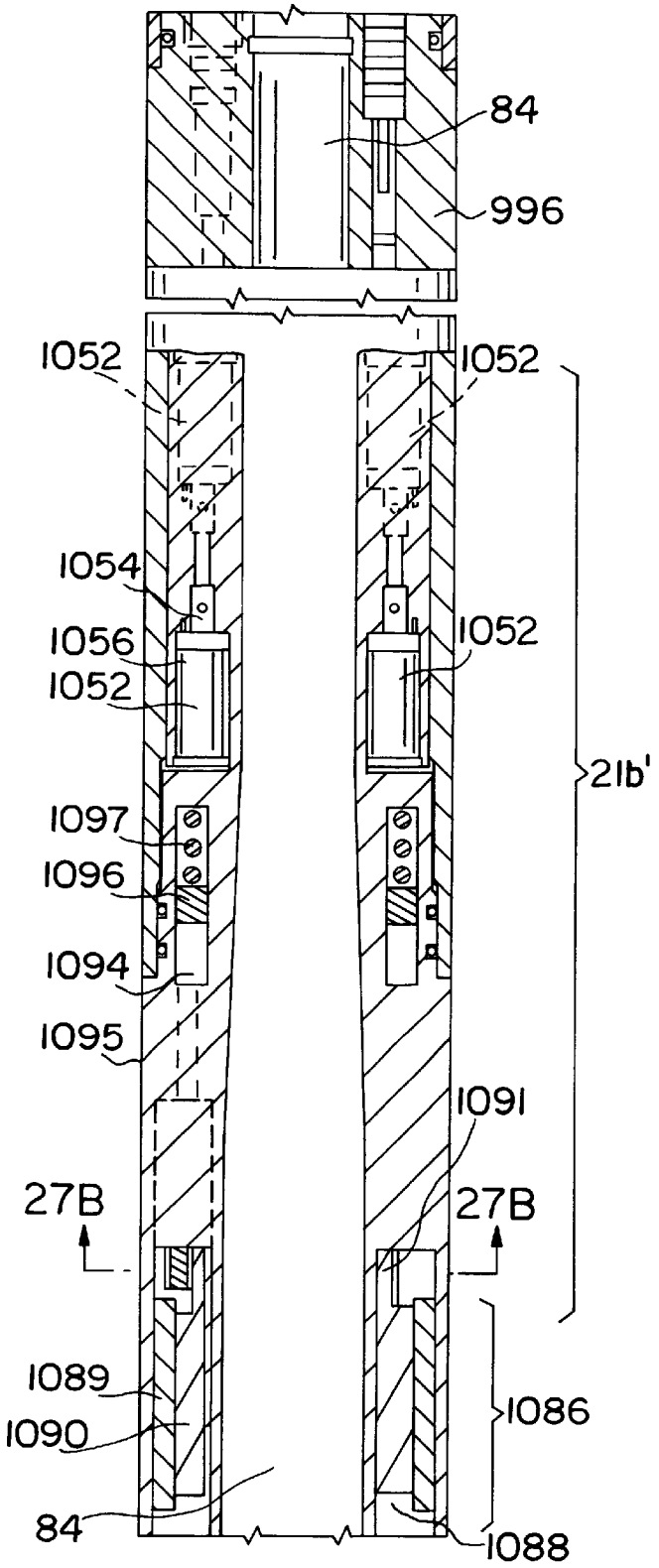
FIG. 27A is a cross-sectional view depicting an alternate exemplary embodiment of the hydraulic power sub in accordance with the present invention.

An alternate exemplary embodiment of the power sub, now designated 21*b*', may be understood by referring now to FIGS. 27A and 27B. FIG. 27A is a sectional view like FIG. 25 and FIG. 27B is a cross-sectional view of FIG. 27A taken at section 27B—27B. The provision and arrangement of solenoids 1052 for selectively routing hydraulic fluid to the various wheel modules 19*a*–19*f* may be as described above and shown in FIG. 25. However, in this embodiment, hydraulic fluid is pressurized and delivered by an annularly-shaped motor 1086 coupled to a pump 1087 positioned in a chamber in the housing 996 near the O.D. of the housing 996. The motor 1086 is positioned in an annular space 1088 in the housing 996 and consists of a stator 1089 and an annular rotor 1090 rotatably positioned inside the stator 1089. One end 1091 of the rotor 1090 has a reduced diameter and a set of external gear teeth 1092, best seen in FIG. 27B. The pump 1087 is provided with a pinion gear 1093 that is engaged with and driven by the gear teeth 1092 of the rotor 1090. The pump 1087 is tied to an annular tank 1094 by passages, one of which is shown in phantom and designated 1095. The tank 1094 is pressure compensated like the tank 1028 depicted in FIG. 25, albeit with an annular piston 1096 biased with a spring 1097. If desired, several pumps like the pump 1087 shown may be spaced around the circumference of the housing 996 and powered by the motor 1086. This embodiment eliminates for the need to reroute the main working fluid flow bore 84.

Figure 28:
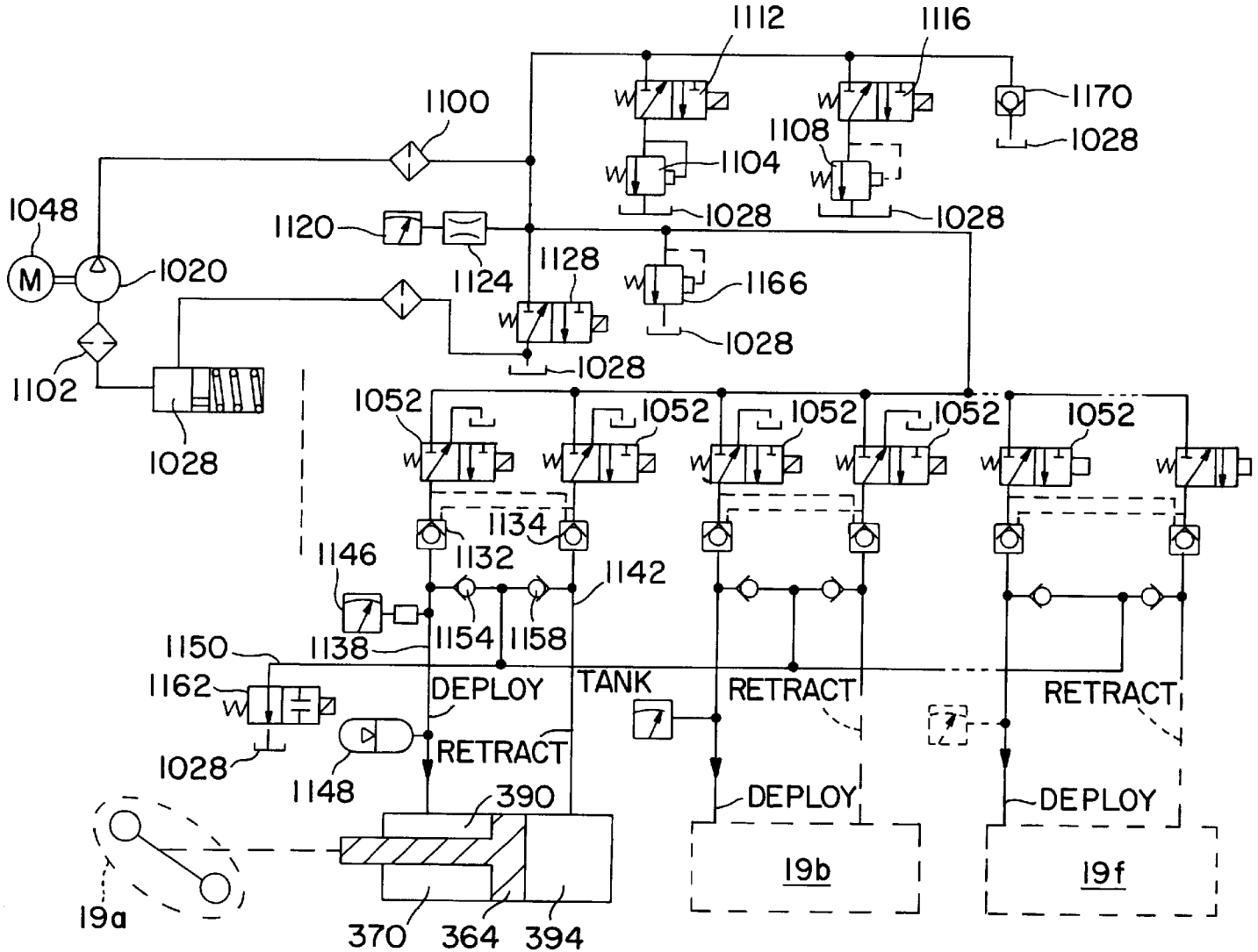
FIG. 28 is a schematic of the hydraulic system for the downhole tractor in accordance with the present invention.

The hydraulic system for the downhole tractor 10 may be understood by referring now to FIGS. 5, 25 and 28. FIG. 28 is an overall schematic representation of the hydraulic system for the downhole tractor 10. As shown in FIG. 28, the inlet and discharge of the pump 1020 are cleansed by filters 1100 and 1102. Pressure regulating valves 1104 and 1108 are tied to the discharge of the pump 1020 by respective solenoid valves 1112 and 1116. The pressure regulating valves 1104 and 1108 are set at preselected maximum values to enable the operator to selectively determine the maximum operating pressure for the hydraulic system. For example, the valve 1104 may have a limit of 2000 psi and the valve a limit of 3000 psi. By energizing one or the other of the solenoid valves 1112 or 1116, the system pressure limit may be set at 2000 psi or 3000 psi. The solenoid valves 1112 and 1116 are normally closed, and are designed to enable selective access to the pressure regulating valves 1104 and 1108. The number of pressure regulating valves, such as the valves 1104 and 1108, supplied for the system is largely a matter of design discretion.

The pressure regulating valves 1104 and 1108 are tied to the pressure regulated reservoir or tank 1028, which is represented schematically proximate various of the components in the schematic of FIG. 28. The term "tank" refers to the various spaces and passages holding hydraulic fluid in the tractor 10. To enable the pump 1020 and the motor 1048 to start under a no-load condition, the discharge of the pump 1020 is tied to a normally closed solenoid valve 1128 that discharges to tank 1028 when actuated. Just prior to start up of the pump 1020 and the motor 1048, the solenoid 1128 is actuated to enable fluid delivered from the pump 1020 to circulate without load. After the pump 1020 and motor 1048 are up and running, the solenoid valve 1128 is shut off. A pressure transducer 1120 is tied to the pump discharge and is provided with a flow restrictor 1124 as a protection against pressure spikes. The transducer 1120 is designed to sense the pressure delivered from the pump 1020. Similar flow restrictors are provided for the other transducers to be described below, but are not shown for simplicity of illustration.

The discharge of the pump 1020 is also tied to a plurality of solenoid valves, which are collectively designated 1052 in FIG. 25 and FIG. 28. As noted above in the description related to FIG. 25, there typically will be two solenoid valves 1052 for each wheel module 19*a*, 19*b* etc., or grouping of modules. FIG. 28 illustrates the hydraulic connection between two of the solenoid valves 1052 and the actuating ram 364 and cylinder 370 arrangement that is mechanically linked to the wheel module 19*a*, represented schematically. The linkages between the other pairs of solenoid valves 1052 and their respective wheel modules 19*b* . . . 19*f* are depicted schematically and in phantom. The following description of the solenoid valves 1052 coupled to the actuating ram 364 and cylinder 370 arrangement will be illustrative of the other pairs of solenoid valves 1052. The solenoid valves 1052 are normally closed with outputs tied to pilot operated check valves 1132 and 1134. The pilot operated check valve 1132 is coupled to a deploy hydraulic line 1138 that feeds fluid to the side 390 of the cylinder 370. A retract line 1142 is coupled to the output of the check valve 1134 and feeds fluid to the side 394 of the cylinder 370. When the solenoid 1052 coupled to the deploy line 1138 is energized, the check valve 1132 opens enabling fluid to flow into the side 390 of the cylinder and move the ram 364 to the right. At the same time, the pilot valve 1134 is opened, enabling fluid from the right side 394 of the cylinder to flow out of the cylinder 370. The pressure of the fluid in the deploy line 1138 is sensed by a transducer 1146. An accumulator 1148 may be tied to the line 1138, and like accumulators (not shown) may be positioned relative to the other solenoid valves 1052.

In the event that electrical power is lost to the downhole tractor 10, it is desirable for the various wheel assemblies 20*a*–20*i* to automatically retract into the housing 16 of the tool 10. To enable pressure trapped in the deploy and retract lines 1138 and 1142 to vent in the event of power loss, the lines 1138 and 1142 are tied to a main return to tank line 1150 by a pair of check valves 1154 and 1158. The return to tank line 1150 is tied to a normally open solenoid 1162, which is, in turn, tied to tank 1028. If power is lost, the solenoid valve 1162 will open, enabling fluid pressure in the lines 1138 and 1142 to open the check valves 1154 and 1158 and dump to tank 1028, enabling the wheel assemblies 20*a*–20*i* to retract manually via tool weight. Optionally, though not shown, the ram 364 may be spring biased to retract to aid in manual retraction.

A main pressure reducing valve 1166 is tied to the discharge of the pump 1020 upstream from the solenoids 1052. The pressure reducing valve 1166 is set at the maximum desired operating pressure for the solenoid valves 1052, and is provided primarily as a backup pressure regulating device in the event the solenoid valves 1112 and 1116 fail or otherwise lose power. A check valve 1170 ties tank 1028 to the discharge of the pump 1020 to enable tank pressure to be vented to all of the various lines and conduits on the inlet sides of the solenoid valves 1052. This is desirable to avoid significant pressure differentials in those various lines and conduits that may occur as a result of pressure build-up in the tank 1028 due to high pressures encountered in wellbore 14.

Figure 29:
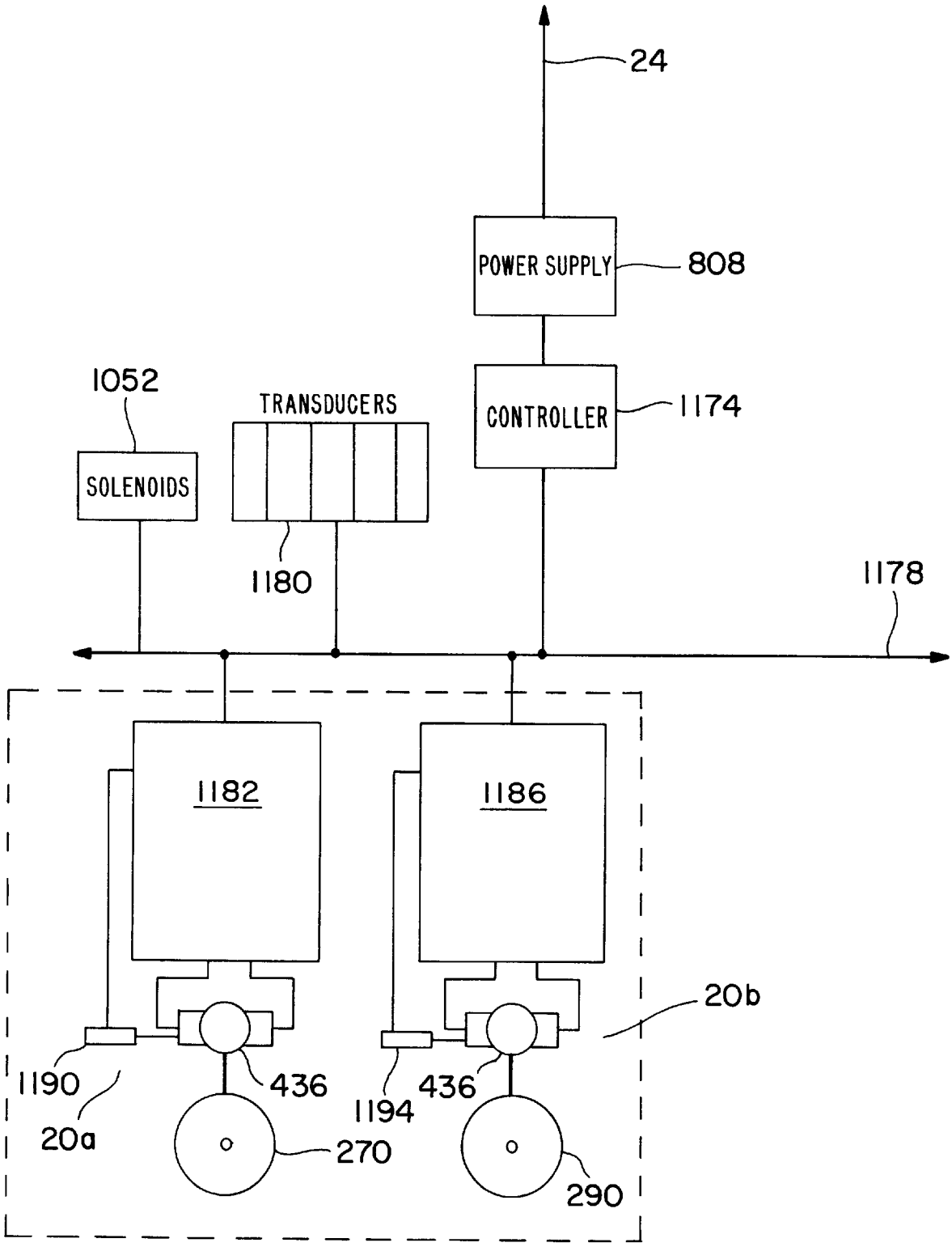
FIG. 29 is a block diagram of the electronic components of the downhole tractor in accordance with the present invention.

The internal circuitry for the downhole tractor 10 may be understood by referring now to FIGS. 1, 5, 18, 28 and 29. FIG. 29 is a block diagram of the internal circuitry and shows a simplified schematic view of power and control circuitry common to the downhole tractor 10, and more specific circuitry coupled to the wheel assemblies 20*a* and 20*b*. The wireline conductor 24 is connected to the onboard power supply 808 (see FIG. 18), which is, in turn, coupled to an onboard controller 1174. The controller 1174 may be a microprocessor or other type of integrated circuit. In an illustrative embodiment, a Microchip brand model 16C74 may be used. The controller 1174 is connected to an internal bus 1178, which stretches throughout the majority of the length of the downhole tractor 10. The various solenoids 1052 provided to control the flow of hydraulic fluid to and from the various wheel assemblies 20*a*–20*i* are connected to the controller 1174 via the internal bus 1178. The various transducers for sensing the pressure in the multitude of fluid conduits in the tractor 10 are connected to the controller 1174 and are collectively designated 1180 in FIG. 29 for simplicity of illustration.

The wheel assemblies 20*a* and 20*b* are provided with respective controllers 1182 and 1186, which perform a variety of electronic functions for each of the wheel assemblies 20*a* or 20*b*. For example, the controllers 1182 and 1186 control the flow of current to, and thus the speed and on/off functions of, the motors 436. In addition, the controllers 1182 and 1186 handle the solid state gate triggering to switch between the phases and control the forward and reverse rotation of the motors 436. In addition, the controllers acquire data on the temperatures of the motors 436 via temperature sensors 1190 and 1194 respectively coupled to the motors 436. The temperature sensors 1190 and 1194 may thermocouples or other types of temperature sensors. Motor speed is also interpreted by the controllers 1182 and 1186.

The main controller 1174 receives data from the motor controllers 1182 and 1186 and is operable to control a variety of functions on the downhole tractor 10. For example, the controller 1174 may be programmed to maintain the rotational speeds of the motors 436 of all the wheel assemblies 20*a*–20*i* within a preselected range. In this way, the speeds of the motors 436 may be controlled so that a more unified application of thrust is applied by the downhole tractor 10.

The arrangement of the various internal electronic components for the tool 10 is largely a matter of design discretion. The various controllers 1174, 1182, 1186, as well as the similar controllers (not shown) for each of the wheel assemblies 20*b*–20*i* may be incorporated into the various boards 816, 820, 824, 828, 832 or 836 shown in FIG. 19 or elsewhere in the tractor 10.

The operation of the downhole tractor 10 may be understood by referring now to FIGS. 1, 5, 6, 28 and 29. The tractor 10 is inserted into the wellbore 14 and power is supplied to the onboard electronics, namely the power supply 808 and the controller 1174. Some or all the transducers 1180 may be energized at any point after insertion into the wellbore 14 to enable sensing of pressure conditions during insertion. Assume for the purpose of the remainder of the illustration, that it is desired to deploy and turn on wheel assemblies 20*a* and 20*b* of the wheel module 19*a*. A command is sent from the surface controller 36 to the onboard controller 1174 directing the deployment and activation of the wheel module 19*a*. Initially, the wheel assemblies 20*a* and 20*b* will be in the retracted positions shown in FIG. 5. Just prior to hydraulic pump 1020 and motor 1048 activation, the controller 1174 activates and opens the soft-start solenoid 1128 and closes the emergency release solenoid 1162. The controller 1174 then activates the pump 1020 and the motor 1048 to begin circulation of hydraulic fluid. At this point, the various deploy solenoids 1052 for those wheel modules to be deployed, in this case, wheel module 19*a*, are opened. Just prior to activating one of the deployment solenoid valves 1052, the soft-start solenoid 1128 is closed and one of the pressure regulating solenoids 1112 or 1116 is energized to set a preselected operating pressure for the system. When the deployed solenoid 1052 is energized, fluid flows into the side 390 of the cylinder 370 propelling the ram 364 to the right and causing the pivot arm 248 to rotate clockwise from the position shown in FIG. 5 to the position shown in FIG. 6 to deploy the wheel assemblies 20*a* and 20*b*. When the pressure delivered to the side 390 of the cylinder 370 reaches the preselected system operating pressure set by one of the solenoid valves 1112 or 1116, as sensed by the transducers 1120 and 1146, the controller 1174 may deactivate the solenoid 1052 coupled to the side 390.

At the time the wheel assemblies 20*a* and 20*b* are deployed, a command may be sent from the controller 36 through the controller 1174 directing the motor controllers 1182 and 1186 to activate the wheel motors 436 of the wheel assemblies 20*a* and 20*b*. Data on the operating parameters of the motors 436, such as temperature, rpm and current draw is obtained by the motor controllers 1182 and 1186 and relayed to the controller 1174 and, in turn, to the surface controller 36. The motor controllers 1182 and 1186 may be configured to deliver and maintain a preselected voltage level to the motors 436 and sense the current draw of the motors 436 in response to load applied to the wheels 270 and 290. Alternatively, the current flow may be metered to regulate rpm of the motors 436.

The controller 1174 may be programmed to maintain the rpms of the wheels 270 and 290 within a preselected range so that the various wheels of the tractor 10 rotate at roughly the same speed. The controller 1174 is operable to sense a deviation in rpm, or current or temperature from the preselected normal operating ranges for a given wheel assembly, such as the assembly 20*a*, and take corrective action where necessary. For example, if the controller 1174 senses that the temperature operating temperature of the wheel assembly 20*a* is exceeding a maximum normal range, the controller 1174 can send a command to the motor controller 1182 to turn off the motor 436. This type of individualized rpm and on-off control for the wheel assembly 20*a* may be performed on any of the wheel assemblies 20*a*–20*i* of the tractor 10.

To retract the wheel assemblies 20*a* and 20*b* of the wheel module 19*a*, the foregoing process is reversed in-part. A command to retract the wheel assemblies 20*a* and 20*b* is relayed from the controller 36 to the controller 1174. If the deploy solenoid 1052 connected to the side 390 of the cylinder 370 has not already been turned off, the controller 1174 turns that solenoid 1052 off and opens the solenoid 1052 connected to the retract side or side 394 of the cylinder 370. The flow of pressurized fluid into the side 394 propels the ram 364 to the left and causes the pivot arm 248 to pivot from the position shown in FIG. 6 back to the retracted position shown in FIG. 5.

The skilled artisan will appreciate that the downhole tractor 10 of the present invention provides significant flexibility and capability in propelling wirelines or other members in downhole environments. Indeed, while the detailed description has been the context of a wireline within a coiled tubing, the tractor 10 may be employed with wireline alone, with threaded pipe and a wireline, or with a coiled tubing or threaded pipe and power conductor other than a wireline. The various wheel assemblies 20*a*–20*i* are independently electrically powered and separably controllable, providing for significant redundancy in the event that one of the wheel assemblies 20*a*–20*i* fails downhole and enabling synchronization of the rotating speeds of the wheels assemblies 20*a*–20*i*. The incorporation of the flexible reduction gears into the wheels assemblies 20*a*–20*i* enables the transmission of high torque without the necessity of complex shaft, U-joint and other types of gearing arrangements. Separate subs or modules may be used or the various components may be integrated into a single sub. Multiple wheel assemblies may be grouped into a single sub.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A downhole tractor, comprising:

a housing;

a first wheel assembly coupled to the housing and being operable to translate away from the housing in a first direction, the first wheel assembly having a first electric motor and a first wheel coupled to the first electric motor;

a second wheel assembly coupled to the housing and being operable to translate away from the housing in a second direction that is opposite to the first direction, the second wheel assembly having a second electric motor and a second wheel coupled to the second electric motor; and means for selectively translating the first and second wheel assemblies toward and away from the housing.

2. The downhole tractor of claim 1, wherein the first and second wheel assemblies are pivotally coupled to the housing.

3. The downhole tractor of claim 2, comprising a pivot arm pivotally coupled to the housing, the first and second wheel assemblies being coupled to the pivot arm.

4. The downhole tractor of claim 3, wherein each of the first and second wheel assemblies is pivotally coupled to the pivot arm.

5. The downhole tractor of claim 1, wherein each of the wheel assemblies comprises a reduction gear assembly coupled to a given electric motor and a given wheel.

6. The downhole tractor of claim 1, wherein each of the first and second electric motors comprises a hub having an internal bore, a stator coupled to the hub, a rotor positioned in the hub, and a reduction gear coupling the rotor to a given wheel.

7. The downhole tractor of claim 6, wherein the wheel comprises a mandrel having a portion positioned in the hub and a first rim and a second rim positioned in spaced-apart relation outside the hub.

8. The downhole tractor of claim 6, wherein the hub has a set of internal gear teeth, the rotor has a an elliptical cross-section with a major elliptical axis, and the reduction gear comprises a flexible cylindrical cup having a set of external teeth, the elliptical cross-section of the rotor causing first and second portions of the set of external teeth to engage third and fourth portions of the set of internal teeth at two opposite zones across the major elliptical axis.

9. The downhole tractor of claim 8, wherein the set of internal teeth comprises N teeth, the set of external teeth comprises N−2 teeth, and rotation of the rotor in a first direction causes rotation of the flexible cylindrical cup in a second direction opposite to the first direction.

10. The downhole tractor of claim 1, wherein each of the first and second electric motors comprises a rotor having an internal bore, a hub positioned in the internal bore, a stator coupled to the hub, and a reduction gear coupling the rotor to a given wheel.

11. The downhole tractor of claim 10, wherein the wheel has a set of internal gear teeth, the rotor has an elliptical cross-section with a major elliptical axis, and the reduction gear comprises a flexible cylindrical cup having a set of external teeth, the elliptical cross-section of the rotor causing first and second portions of the set of external teeth to engage third and fourth portions of the set of internal teeth at two opposite zones across the major elliptical axis.

12. The downhole tractor of claim 11, wherein the set of internal teeth comprises N teeth, the set of external teeth comprises N−2 teeth, and rotation of the rotor in a first direction causes rotation of the flexible cylindrical cup in a second direction opposite to the first direction.

13. The downhole tractor of claim 1, wherein the means for selectively translating the first and second wheel assemblies toward and away from the housing comprises a hydraulic ram coupled to the housing and the first and second wheel assemblies.

14. The downhole tractor of claim 13, comprising a hydraulic fluid pump and reservoir positioned in the housing for supplying pressurized hydraulic fluid to the hydraulic ram.

15. The downhole tractor of claim 1, wherein the means for selectively translating the first and second wheel assemblies toward and away from the housing comprises a first hydraulic ram coupled to the housing and the first wheel assembly, and a second hydraulic ram coupled to the housing and the second wheel assembly.

16. The downhole tractor of claim 1, wherein the means for selectively translating the first and second wheel assemblies toward and away from the housing comprises a powered worm gear coupled to the housing and the first and second wheel assemblies.

17. The downhole tractor of claim 1, comprising a first controller electrically connected to the first electric motor and a second controller electrically connected to the second electric motor for controlling the supply of electrical current to the first and second electric motors.

18. The downhole tractor of claim 17, comprising a power supply and a third controller for controlling the supply of current to the first and second controllers.

19. The downhole tractor of claim 18, comprising a fourth controller for controlling the supply of current to the third controller.

20. The downhole tractor of claim 19, wherein the fourth controller comprises a computer positioned at ground level.

21. A wheel assembly for a downhole tractor, comprising:

an electric motor having a hub, a stator coupled to the hub, and a rotor coupled to the hub;

a wheel coupled to the rotor; and a reduction gear assembly coupled between the rotor and the wheel.

22. The wheel assembly of claim 21, wherein the rotor has an internal bore and an elliptical cross-section with a major elliptical axis, the hub is positioned in the internal bore, the wheel has a set of internal gear teeth, and the reduction gear comprises a flexible cylindrical cup having a set of external teeth, the elliptical cross-section of the rotor causing first and second portions of the set of external teeth to engage third and fourth portions of the set of internal teeth at two opposite zones across the major elliptical axis.

23. The wheel assembly of claim 22, wherein the set of internal teeth comprises N teeth, the set of external teeth comprises N−2 teeth, and rotation of the rotor in a first direction causes rotation of the flexible cylindrical cup in a second direction opposite to the first direction.

24. The wheel assembly of claim 21, wherein the hub has a set of internal gear teeth, the rotor has an elliptical cross-section with a major elliptical axis, and the reduction gear comprises a flexible cylindrical cup having a set of external teeth, the elliptical cross-section of the rotor causing first and second portions of the set of external teeth to engage third and fourth portions of the set of internal teeth at two opposite zones across the major elliptical axis.

25. The downhole tractor of claim 24, wherein the set of internal teeth comprises N teeth, the set of external teeth comprises N−2 teeth, and rotation of the rotor in a first direction causes rotation of the flexible cylindrical cup in a second direction opposite to the first direction.

26. The wheel assembly of claim 21, comprising a first controller electrically connected to the electric motor for controlling the flow of electrical current thereto.

27. The wheel assembly of claim 21, comprising a power supply and a second controller for controlling the supply of current to the first controller.

28. The wheel assembly of claim 25, wherein the wheel comprises a mandrel having a portion positioned in the hub and a first rim and a second rim positioned in spaced-apart relation outside the hub.

29. A downhole tractor, comprising:

a housing;

a first wheel assembly coupled to the housing and being operable to translate away from the housing in a first direction, the first wheel assembly having a first electric motor, a first wheel, and a first reduction gear assembly coupled between the first electric motor and the first wheel;

a second wheel assembly coupled to the housing and being operable to translate away from the housing in a second direction that is opposite to the first direction, the second wheel assembly having a second electric motor, a second wheel, and a second reduction gear assembly coupled between the second electric motor and the second wheel;

a fluid ram coupled to the first and second wheel assemblies for selectively translating the first and second wheel assemblies toward and away from the housing; and a first controller for controlling the flow of current to the first and second electric motors.

30. The downhole tractor of claim 29, wherein the first and second wheel assemblies are pivotally coupled to the housing.

31. The downhole tractor of claim 30, comprising a pivot arm pivotally coupled to the housing, the first and second wheel assemblies being coupled to the pivot arm.

32. The downhole tractor of claim 31, wherein each of the first and second wheel assemblies is pivotally coupled to the pivot arm.

33. The downhole tractor of claim 29, wherein each of the first and second electric motors comprises a hub having an internal bore, a stator coupled to the hub, and a rotor positioned in the hub, the given reduction gear assembly coupling the rotor to a given wheel.

34. The downhole tractor of claim 33, wherein the wheel comprises a mandrel having a portion positioned in the hub and a first rim and a second rim positioned in spaced-apart relation outside the hub.

35. The downhole tractor of claim 33, wherein the hub has a set of internal gear teeth, the rotor has a an elliptical cross-section with a major elliptical axis, and the reduction gear comprises a flexible cylindrical cup having a set of external teeth, the elliptical cross-section of the rotor causing first and second portions of the set of external teeth to engage third and fourth portions of the set of internal teeth at two opposite zones across the major elliptical axis.

36. The downhole tractor of claim 35, wherein the set of internal teeth comprises N teeth, the set of external teeth comprises N−2 teeth, and rotation of the rotor in a first direction causes rotation of the flexible cylindrical cup in a second direction opposite to the first direction.

37. The downhole tractor of claim 29, wherein each of the first and second electric motors comprises a rotor having an internal bore, a hub positioned in the internal bore, a stator coupled to the hub, and a reduction gear coupling the rotor to a given wheel.

38. The downhole tractor of claim 37, wherein the wheel has a set of internal gear teeth, the rotor has an elliptical cross-section with a major elliptical axis, and the reduction gear comprises a flexible cylindrical cup having a set of external teeth, the elliptical cross-section of the rotor causing first and second portions of the set of external teeth to engage third and fourth portions of the set of internal teeth at two opposite zones across the major elliptical axis.

39. The downhole tractor of claim 38, wherein the set of internal teeth comprises N teeth, the set of external teeth comprises N−2 teeth, and rotation of the rotor in a first direction causes rotation of the flexible cylindrical cup in a second direction opposite to the first direction.

40. The downhole tractor of claim 29, comprising a fluid pump and reservoir positioned in the housing for supplying pressurized fluid to the fluid rain.

41. The downhole tractor of claim 40, wherein the fluid is hydraulic fluid.

42. The downhole tractor of claim 29, comprising a second controller electrically connected to the first electric motor and the first controller, and a third controller electrically connected to the second electric motor and the first controller for controlling the supply of current from the first controller to the first and second electric motors.

43. The downhole tractor of claim 29, comprising a power supply positioned in the housing for supplying current to the first and second electric motors.

44. The downhole tractor of claim 43, comprising a fourth controller for controlling the supply of current to the first controller.

45. The downhole tractor of claim 44, wherein the fourth controller comprises a computer positioned at ground level.

46. A downhole tractor, comprising:

a housing;

a drive structure carried by the housing and operative to propel the housing along a surface exterior thereto, the drive structure having a rotatable portion operative to engage the surface; and a motor disposed within the rotatable portion and operative to rotate it.

47. The downhole tractor of claim 46 wherein the drive structure includes a wheel defining the rotatable portion and being directly engageable with the surface.

48. The downhole tractor of claim 46 wherein the motor is an electric motor.

49. The downhole tractor of claim 46 wherein:

the drive structure includes a wheel assembly, and the motor is disposed within the wheel assembly.

50. The downhole tractor of claim 49 wherein the motor is an electric motor.

51. The downhole tractor of claim 50 wherein:

the wheel assembly includes:

a hub, and a wheel associated with the hub for rotation relative thereto, and the electric motor disposed within the wheel assembly includes:

a stator held stationary relative to the hub, a rotor rotatable relative to the hub and stator and drivingly coupled to the wheel.

52. The downhole tractor of claim 51 wherein the rotor is positioned within the stator.

53. The downhole tractor of claim 51 wherein the rotor is drivingly coupled to the wheel by a reduction gear structure.

54. A downhole tractor, comprising:

a housing;

a wheel assembly carried by the housing and being useable to propel it along a surface, the wheel assembly including a wheel rotatable relative to the housing; and a motor disposed within the wheel assembly and drivingly coupled to the wheel.

55. The downhole tractor of claim 54 wherein the wheel assembly is translatable toward and away from the housing.

56. The downhole tractor of claim 55 further comprising translation apparatus for selectively translating the wheel assembly toward and away from the housing.

57. The downhole tractor of claim 56 wherein the wheel assembly is pivotally coupled to the housing.

58. The downhole tractor of claim 54 wherein the motor is an electric motor.

59. The downhole tractor of claim 54 wherein:

the wheel assembly includes a hub on which the wheel is rotatably supported, and the electric motor is disposed within the hub.

60. The downhole tractor of claim 59 wherein the electric motor includes:

a stator anchored to the hub, and a rotor rotatable relative to the stator and drivingly coupled to the wheel.

61. The downhole tractor of claim 60 wherein the rotor is drivingly coupled to the wheel by a reduction gear structure.

62. The downhole tractor of claim 60 wherein the rotor is disposed within the stator.

63. The downhole tractor of claim 54 wherein the wheel is directly and drivingly engageable with the surface.

64. A wheel assembly for a downhole tractor, comprising:

a hub;

a wheel rotatable relative to the hub; and a motor disposed within the hub and operative to rotationally drive the wheel relative to the hub.

65. The wheel assembly of claim 64 wherein the motor is an electric motor.

66. The wheel assembly of claim 65 wherein the electric motor is drivingly coupled to the wheel by a reduction gear assembly.

67. The wheel assembly of claim 65 wherein the electric motor includes:

a stator anchored to the hub, and a rotor rotatable relative to the stator and drivingly coupled to the wheel.

68. The wheel assembly of claim 67 wherein the rotator is disposed within the stator.

69. A wheel assembly for a downhole tractor, comprising:

a hub;

an electric motor carried within the hub and including a stator and a rotor rotatable relative to the stator;

a wheel rotatable relative to the hub; and a reduction gear assembly drivingly coupling the rotor to the wheel.

70. The wheel assembly of claim 69 wherein:

the rotor has an internal bore and an elliptical cross-section with a major elliptical axis, the hub is positioned in the internal bore, the wheel has a set of internal gear teeth, and the reduction gear assembly comprises a flexible cylindrical cup having a set of external teeth, the elliptical cross-section of the rotor causing first and second portions of the set of external teeth to engage third and fourth portions of the set of internal teeth at two opposite zones across the major elliptical axis.

71. The wheel assembly of claim 70 wherein:

the set of internal teeth comprises N teeth, the set of external teeth comprises N−2 teeth, and rotation of the rotor in a first direction causes rotation of the flexible cylindrical cup in a second direction opposite to the first direction.

72. The wheel assembly of claim 69 wherein:

the hub has a set of internal gear teeth, the rotor has an elliptical cross-section with a major elliptical axis, and the reduction gear comprises a flexible cylindrical cup having a set of external teeth, the elliptical cross-section of the rotor causing first and second portions of the set of external teeth to engage third and fourth portions of the set of internal teeth at two opposite zones across the major elliptical axis.

73. The wheel assembly of claim 72 wherein:

the set of internal teeth comprises N teeth, the set of external teeth comprises N−2 teeth, and rotation of the rotor in a first direction causes rotation of the flexible cylindrical cup in a second direction opposite to the first direction.

74. The wheel assembly of claim 69 further comprising a first controller electrically connected to the electric motor for controlling the flow of electrical current thereto.

75. The wheel assembly of claim 74 further comprising a power supply and a second controller for controlling the supply of current to the first controller.

76. The wheel assembly of claim 69 wherein the wheel comprises a mandrel having a portion positioned in the hub and a first rim and a second rim positioned in spaced-apart relation outside the hub.

* * * * *